US010479597B2

(12) United States Patent
Cheng et al.

(10) Patent No.: US 10,479,597 B2
(45) Date of Patent: Nov. 19, 2019

(54) TAMPER-PROOF CASE SYSTEMS AND METHODS

(71) Applicant: CITADEL CASING LTD, Road Town, Tortola (VG)

(72) Inventors: Lewis Ka Hang Cheng, Hong Kong (CN); Douglas Rumsam, Hong Kong (CN); Timothée Lesné, Paris (FR); Victor Hugo Ocegueda Gallaga, Baja California (MX); Yifeng Zhang, Xinxiang (CN); Jaime Ramos, Moorpark, CA (US)

(73) Assignee: CITADEL CASING LTD, Road Town (VG)

( * ) Notice: Subject to any disclaimer, the term of this patent is extended or adjusted under 35 U.S.C. 154(b) by 0 days.

(21) Appl. No.: 16/002,768

(22) Filed: Jun. 7, 2018

(65) Prior Publication Data

US 2018/0354711 A1 Dec. 13, 2018

Related U.S. Application Data

(60) Provisional application No. 62/672,894, filed on May 17, 2018, provisional application No. 62/516,362, filed on Jun. 7, 2017.

(51) Int. Cl.
*B65D 85/30* (2006.01)
*B65D 81/05* (2006.01)
(Continued)

(52) U.S. Cl.
CPC ..... *B65D 85/305* (2013.01); *B65D 9/06* (2013.01); *B65D 9/18* (2013.01); *B65D 11/1873* (2013.01); *B65D 11/1893* (2013.01); *B65D 21/0202* (2013.01); *B65D 25/10* (2013.01); *B65D 25/54* (2013.01); *B65D 43/16* (2013.01); *B65D 81/052* (2013.01); *B65D 81/107* (2013.01); *B65D 2101/0007* (2013.01); *B65D 2211/00* (2013.01)

(58) Field of Classification Search
CPC ..... B65D 11/1873; B65D 11/1893; B65D 21/0202; B65D 25/54; B65D 43/16; B65D 81/051; B65D 81/052; B65D 81/107; B65D 2211/00; B65D 85/305; B65D 9/18; B65D 9/14; B65D 9/16; B65D 1/243
USPC ..... 206/784, 103–203, 775–783, 1.5, 427, 206/210, 433
See application file for complete search history.

(56) References Cited

U.S. PATENT DOCUMENTS 1,471,428 A * 10/1923 Tucker ..... B65D 9/14 217/46
2,935,222 A * 5/1960 O'Connell ..... B65D 21/08 206/433
(Continued)

*Primary Examiner* — Chun Hoi Cheung
(74) *Attorney, Agent, or Firm* — Troutman Sanders LLP; Ryan A. Schneider; Christopher C. Close, Jr.

(57) ABSTRACT

The disclosed systems and methods relate to improved tamper-proof cases for securely storing and shipping products. In one example, a tamper-proof case comprises a unibody frame constructed from a single piece of material. The unibody frame can comprise six sides and include one or more living hinges that allow the unibody frame to fold into a completed case. Various sides can be configured to receive panels to give the crate additional structure, rigidity, and security. Additionally, the frame can comprise a split-top lid with a self-locking mechanism with a tamper-proof pull tab for opening the lid.

20 Claims, 31 Drawing Sheets

(51) Int. Cl.

| | |
|---|---|
| ***B65D 25/54*** | (2006.01) |
| ***B65D 25/10*** | (2006.01) |
| ***B65D 43/16*** | (2006.01) |
| ***B65D 6/02*** | (2006.01) |
| ***B65D 6/22*** | (2006.01) |
| ***B65D 6/24*** | (2006.01) |
| ***B65D 21/02*** | (2006.01) |
| ***B65D 81/107*** | (2006.01) |

(56) References Cited

U.S. PATENT DOCUMENTS 3,043,490 A 7/1962 Burnett
3,331,502 A * 7/1967 Stroop ..... B65D 1/243 206/432
3,497,127 A * 2/1970 Box ..... B65D 1/225 220/6
3,747,751 A * 7/1973 Miller ..... B65D 11/188 206/277
3,958,747 A * 5/1976 Chipp ..... B65D 5/12 229/211
4,037,722 A * 7/1977 Bremer ..... B65D 5/509 206/199
4,109,985 A 8/1978 Lieb, Jr.
4,911,300 A * 3/1990 Colonna ..... B65D 71/50 206/427
5,115,937 A * 5/1992 Chausse ..... B65D 21/0233 206/144
5,351,814 A * 10/1994 Apps ..... B65D 1/243 206/139
5,429,259 A * 7/1995 Robin ..... B65D 9/06 217/65
5,769,230 A * 6/1998 Koefelda ..... B65D 1/243 206/508
5,975,300 A * 11/1999 Gale ..... B65D 5/503 206/433
6,213,297 B1 * 4/2001 Gale ..... B65D 71/50 206/427
6,325,210 B1 * 12/2001 Henry, Jr. ..... B65D 5/503 206/203
7,252,196 B1 * 8/2007 Koefelda ..... B65D 1/246 206/511
7,789,239 B2 * 9/2010 Juliano ..... B65D 5/503 206/564
2008/0093244 A1 * 4/2008 Binah ..... B65D 81/052 206/433
2009/0090709 A1 4/2009 Shalomoff
2014/0197050 A1 * 7/2014 Chiorazzi ..... A45C 5/14 206/141

* cited by examiner

TAMPER-PROOF CASE SYSTEMS AND METHODS

CROSS-REFERENCE TO RELATED APPLICATIONS

This application claims priority and a benefit under 35 U.S.C. § 119(e) of U.S. Provisional Patent Application 62/672,894, filed 17 May 2018 and U.S. Provisional Patent Application 62/516,362, filed 7 Jun. 2017. The disclosures of all of these prior applications are hereby incorporated by reference as if fully set forth below.

TECHNICAL FIELD

Aspects of the present disclosure relate to an improved case or portions thereof for shipping and storing various products, including bottled liquids, and, more particularly, for improving the storage, transport, and protection of products such as beverage bottles including, for instance, wine and other spirit bottles.

BACKGROUND

Wine and other beverage producers commonly use rectangular wooden cases to store and transport bottles of wine. For example, a standard 12-bottle case generally measures 48 cm×41 cm×17 cm and, when empty, weighs approximately 2 kg. Generally, pins, nails, and/or screws hold such wooden cases together. Typically, these wooden cases use carved wooden slats that subdivide the interior of the case and receive the neck and bottom of each bottle to hold the bottles in place within the case. Additionally, Styrofoam or other insulating materials may be added to the interior of the wooden case to protect the bottles.

But these traditional wooden cases present many problems. The thick, wooden sides of the case, which give the cases their strength, add significant shipping weight. Further, the wooden cases can be time consuming to open as they require tools to wedge open the lid, which easily can be damaged when being pried apart from the body of the case. Additionally, once any outside wall of the wooden case is damaged, the structural stability of the box is diminished. Likewise, adding any insulation to the traditional wooden case only increases the weight of the already heavy structure. Finally, the conventional wooden case configuration presents the risk of individual bottles being removed without any evidence of tampering. Further, secure and tamper-proof cases do not exist for transporting and storing other valuable commodities such as, for example, jewelry or cigars.

SUMMARY

Briefly described, the present disclosure relates to a tamper-proof wine crate. The tamper proof-wine crate may comprise four side panels, a bottom panel, a top panel, and a unibody frame. The unibody frame may have a plurality of living hinges. The living hinges may be configured such that the unibody frame can be folded from a first configuration into a second configuration, the first configuration being a substantially horizontal configuration, and the second configuration being a rectangular prism configuration. The rectangular prism comprising four substantially vertical side faces, each of the vertical side faces having a top edge and a bottom edge, and each of the vertical side faces adapted to receive a respective one of the four side panels to form respective crate sidewalls; a substantially horizontal bottom face in mechanical communication with each bottom edge of the vertical side faces, the bottom face having a plurality of bottle heel receiving cups disposed toward an interior volume of the crate, and the bottom face adapted to receive the bottom panel; and a substantially horizontal top face having a first edge in mechanical communication with a first vertical side face's top edge and having a second edge in mechanical communication with a second vertical side face's top edge, the first vertical side face disposed opposite from, and generally parallel to, the second vertical side face, the top face having a plurality of bottle top receiving cups disposed toward the interior volume of the crate, and the top face adapted to receive the top panel.

In addition, at least one crate sidewall may be configured as an observation panel such that the at least one crate sidewall's side face's bottom edge comprises at least one observation panel living hinge tab, and the at least one crate sidewall's side panel comprises (i) a latch configured to engage the top face and (ii) a bottom edge that is in mechanical communication with the at least one observation panel living hinge tab such that, when the latch is disengaged, the observation panel can transition from a first, substantially vertical position, to a second, substantially horizontal position, allowing observation of contents inside the tamper-proof wine crate.

Further, the top face may comprise a sealed hinged lid, the sealed hinged lid having a removable pull tab disposed around first, second, and third edges of the sealed hinged lid. the removable pull tab is removed from the sealed hinged lid, the sealed hinged lid can be transitioned from a closed position to an open position. Also, the removable pull tab may not be replaceable once removed from the sealed hinged lid.

Additionally, the first edge may be in mechanical communication with the first vertical side face's top edge via a first living hinge, the first edge comprising first and second first edge attachment arms at respective first and second ends of the first edge and (ii) the second edge is in mechanical communication with the second vertical side face's top edge via a second living hinge, the second edge comprising first and second edge attachment arms at respective first and second ends of the second edge.

Further, when the first edge and the second edge are in respective first positions, the first and second first edge attachment arms and the first and second edge attachment arms may be in substantially vertical positions, and when the first edge and the second edge are in respective second positions, the first and second first edge attachment arms and the first and second edge attachment arms may be in substantially horizontal positions.

In addition, the first edge attachment arm may be disposed generally opposite the first second edge attachment arm, and the second first edge attachment arm may be disposed generally opposite the second second edge attachment arm.

Also, the first first edge attachment arm and the first second edge attachment arm comprise respective first and second interlocking components of a first locking mechanism and the second first edge attachment arm and the second second edge attachment arm comprise respective first and second interlocking components of a second locking mechanism such that, when the first and second edge are in respective second positions, the respective first and second interlocking components of the first locking mechanism and the respective first and second interlocking components of the second locking mechanism interlock to place the top face in a locked state.

Further, when the top face is in a locked state, the top face cannot be placed in an unlocked state without damaging the first and second locking mechanisms.

BRIEF DESCRIPTION OF THE FIGURES

Reference now will be made to the accompanying figures, which are not necessarily drawn to scale, and wherein.

DETAILED DESCRIPTION

Figure 1:
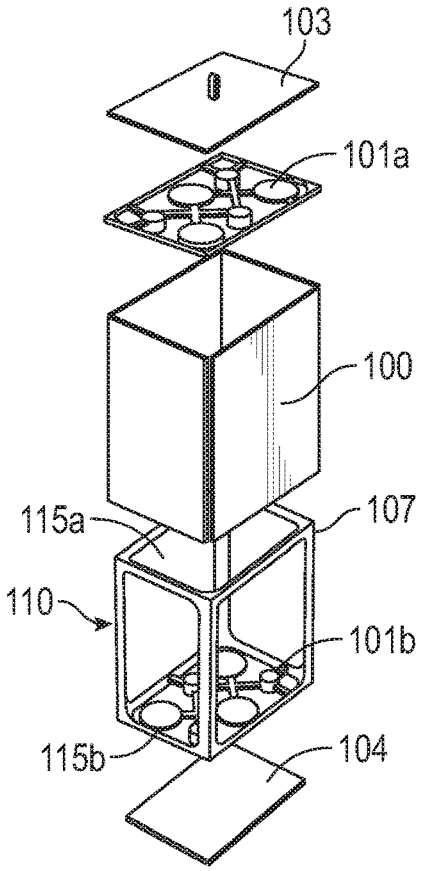
FIG. 1 is an exploded view of a tamper-proof case, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the disclosed technology, for example.

Embodiments of the disclosed technology include a tamper-proof case for storing and transporting bottles of liquid. In various embodiments, a tamper-proof wine case may provide improvements to protecting the integrity of the bottled wine, as well as features that allow a user to more easily use the wine case. A tamper-proof wine case according to the present disclosure may be used by wine manufacturers to package bottles of wine and may also be used by consumers to store the wine bottles at home or to transport the bottles.

Throughout this disclosure, certain embodiments are described in exemplary fashion in relation to storing and transporting bottles of wine. But embodiments of the disclosed technology are not so limited. In some embodiments, the disclosed technique may be effective in storing and transporting bottles or containers of many other types of liquids. For example, the bottle receiving cups, as described herein, could be configured for spirit bottles and other bottles having different shapes and sizes.

Referring now to the drawings, FIG. 1 depicts the components that may make up of a tamper-proof case or crate. Tamper-proof case may include side panels 100 which may be constructed from wood. Side panels 100 may also be constructed from a combination of wood and plastic, cardboard, nano crystalline cellulose cardboard, PVC, rubber, metal, cork, or any other suitable material or combination of materials to provide the desired qualities described herein. Tamper-proof case may include a top pan 103 which may function as a lid and a bottom panel 104. Top panel 103 and bottom panel 104 may be of similar construction to side panels 100.

Additionally, tamper-proof case may comprise bottle holders 101*a* and 101*b*. Bottle holder 101*a* may hold the neck of a wine bottle while bottle holder 101*b* may hold the heel of a wine bottle. Further, bottle holder 101*a* may hold all heels and bottle holder 101*b* may hold all necks, or vice versa. Also, as shown in FIG. 1, bottle holders 101*a* and 101*b* may be configured to hold alternately a wine bottle neck and a wine bottle heel. As will be appreciated, such a configuration allows a user to alternate the direction of the bottles within the wine case to conserve space within the crate. As shown in FIG. 1, bottle holders 101*a* and 101*b* serve the same purpose of holding the ends of a bottle, though in practice, the holders 101*a* and 101*b* hold the opposite end of a particular bottle. For example, if bottle holder 101*a* holds all bottle necks, then bottle holder 101*b* will hold all bottle heels. As shown in FIG. 1 the portion of bottle holder 101*a* intended to hold the heel of a bottle may be particularly sized and shaped to accommodate the heel of a bottle and the opposing portion of the other bottle holder 101*b* may be sized and shaped to accommodate the neck of that bottle, and vice versa. For example, if case is intended to hold wine bottles, the portions of a bottle holders 101*a* or 101*b* intended to hold the heel of the bottles may be cupped so as to fit snugly into the indentation at the bottom of the wine bottles.

Additionally, bottle holders 101*a* and 101*b* may be part of a breakaway frame 110 that serves as the primary structure of the wine case. Bottle holders 101*a* and 101*b* also may be attached to an exterior frame 115*a* or 115*b*. The exterior frames 115*a* and 115*b* can include posts 107 extending from the corner of the exterior frames 115*a* and 115*b*. Breakaway frame 110 may serve as the primary structure of the wine case. Additionally, posts 107 may extend from the bottle holders 101*a* and 101*b* and may serve as the primary structure of the wine case.

As will be appreciated, when breakaway frame 110 serves as the primary structure of the wine case, side panels 100 do not serve as the primary structural component of the case. For example, and as shown in FIG. 1, bottle holder 101*b* may be part of the breakaway frame 110 such that posts 107 may extend from each of the four corners of exterior frame 115*b*. Breakaway frame 110 may also include posts 107 extending from exterior frame 115*a* and 115*b* between the bottles within the case. Also, breakaway frame 110 may include posts 107 extending from the bottle holders 101*a* and 101*b*.

In some embodiments, a tamper-proof case according to the present disclosure does not require side panels 100, top panel 103, and bottom panel 104. For example, bottle holders 101*a* and 101*b*, together with the breakaway frame 110, may provide the entire structural component of the case. As will be appreciated, though the bottles are exposed to the elements, the structural integrity of the case remains intact. Such a design provides the benefit of decreased weight while maintaining a rigid structure to store the bottles or other products.

Figure 2:
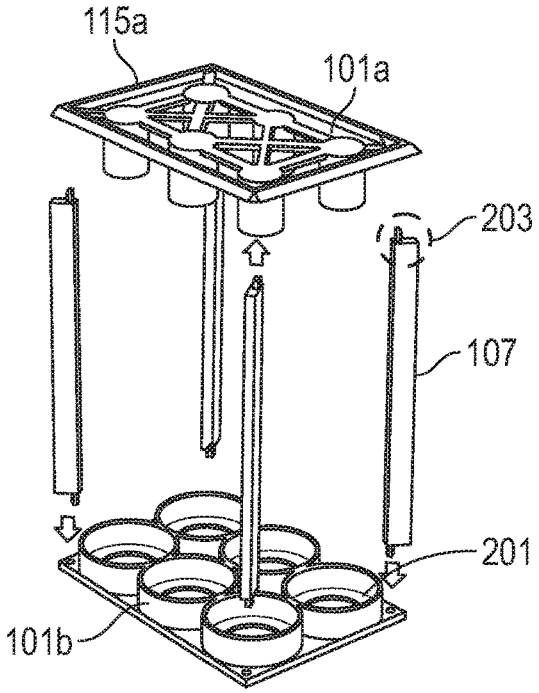
FIG. 2 is a frame of a tamper-proof case, in accordance with an example embodiment of the presently disclosed subject matter.

FIG. 2 depicts the components of a tamper-proof wine frame in accordance with embodiments of the present disclosure. As shown in FIG. 2, bottle holder 101*b* may be configured with bases 201 to hold six individual wine bottle heels, and bottle holder 101*a* may be configured to hold six individual wine bottle necks. Other embodiments may hold any number of bottles to provide the desired qualities described herein. In some embodiments, a bottle holder (e.g., 101*a* and 101*b*) can include an exterior frame. For example, as shown in FIG. 2, bottle holder 101*a* is joined to exterior frame 115*a*. In certain embodiments, bottle holder 101*a* and exterior frame 115*a* can be an integrated component (e.g., 101*a* and exterior frame 115*a* can be a molded component). In other embodiments, and as will be discussed below, the bottle holder 101*a* and exterior frame 115*a* can be detachably attachable.

As further shown in FIG. 2, the bottle holders 101*a* and 101*b* can be detachably attachable at their respective corners via four posts 107. Posts 107 may be constructed from plastic or any other material as necessary for a particular application that will be appreciated of the disclosed technology. Each post 107 may include a connecting feature 203, which can be configured to secure the post 107 to the respective bottle holders 101*a* and 101*b*. In some embodiments, each post 107 can be configured such that it secures directly to the respective exterior frame (e.g. 115*a* or 115*b*). In some embodiments, the connecting feature 203 locks into holders 101*a* and 101*b*. In other embodiments, the connecting feature 203 does not lock into holders 101*a* and 101*b* but instead secures posts 107 to the holders 101*a* and 101*b*, depending on the desired qualities described herein. For instance, in some embodiments, the connecting features 203 lock permanently or are molded directly to holders 101*a* and 101*b*. In some embodiments, connecting feature 203 locks into exterior frames 115*a* or 115*b*. In other embodiments, the connecting features lock permanently or are molded directly to exterior frames 115*a* or 115*b*.

Figure 3:
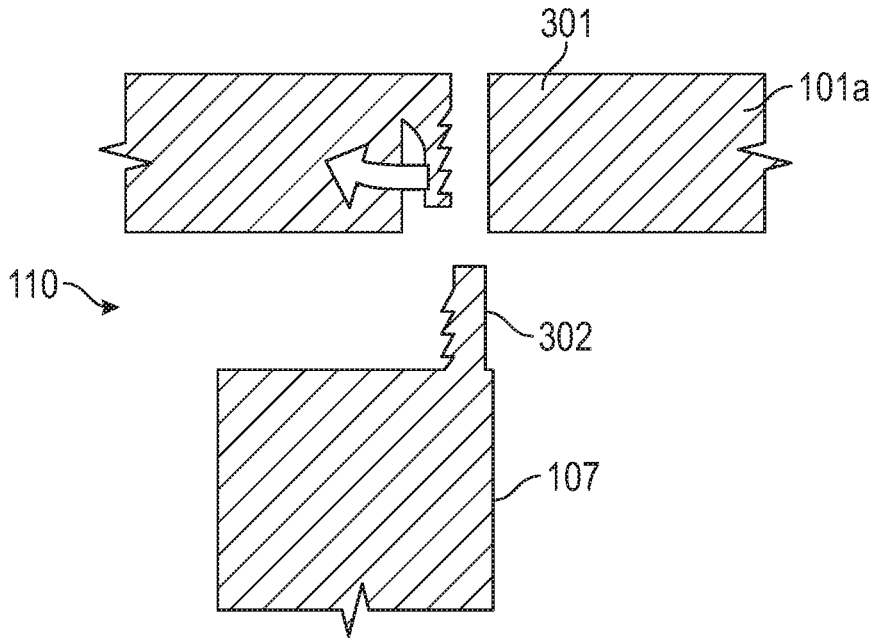
FIG. 3 is a locking feature to create a tamper-evident, breakaway frame for a tamper-proof case, in accordance with an example embodiment of the presently disclosed subject matter.

FIG. 3 is an example connecting feature 203 that creates a tamper-evident, breakaway frame 110 for a bottle case, in accordance with an example embodiment of the presently disclosed subject matter. As shown in FIG. 3, in some embodiments, a connecting feature 203 includes a male section 302 and a female section 301, each of which includes teeth that are designed to interlock. As will be appreciated, when post 107 is inserted into bottle holder 101*a* and/or 101*b*, the connection is locked into place by the teeth, and the connection cannot be taken apart without either female section 301 or male section 302 being broken or drilled. This configuration provides security as it will be evident if any individual bottle has been removed from the case. In some example embodiments, post 107 and holders 101*a* and 101*b* are integrated or permanently attached, and thus no connecting mechanism is necessary. According to some embodiments, the interlocking teeth can be replaced by threads or tabs or other design elements as necessary.

Figure 4:
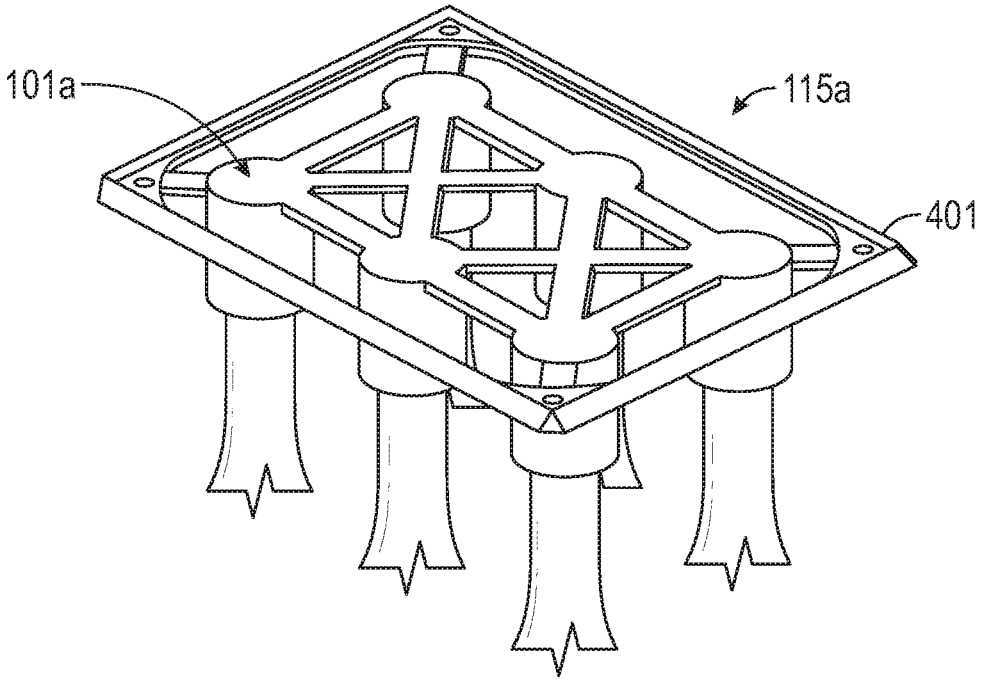
FIG. 4 is a top frame panel with breakaway tabs to create a tamper-evident, breakaway top panel, in accordance with an example embodiment of the presently disclosed subject matter.

FIG. 4 is an embodiment of a holder 101*a*, which can serve as a frame top or end, having breakaway (or breakable) tabs 401 to create a tamper-evident, breakaway top, in accordance with an example embodiment of the presently disclosed subject matter. As shown, holder 101*a* and/or 101*b* can include breakable tabs 401. Thus, in an embodiment where holders 101*a* and 101*b* are permanently attached to posts 107, the bottles in the case cannot be removed without breaking the tabs 401. The tabs 401 may be located in the corners of a holder 101*a* and/or 101*b*, or in any location between the bottles and are not limited by the embodiments herein.

Figure 5:
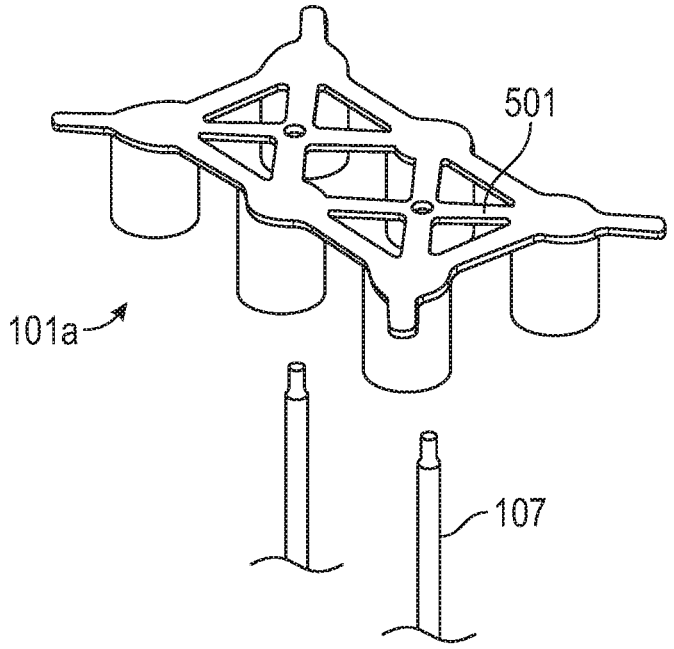
FIG. 5 is a top frame of a tamper-proof case with frame posts for positioning between bottles being contained in the case, in accordance with an example embodiment of the presently disclosed subject matter.

FIG. 5 is an embodiment of a holder 101*a* without an external frame 115*a*. FIG. 5 also depicts posts 107, which are configured for placement between the bottles being contained in the frame and the other ends of which (not shown) can be attached to an opposing holder, in accordance with an example embodiment of the presently disclosed subject matter. As shown in FIG. 5, the holder 101*a* can include slots 501 for receiving the posts 107. In certain embodiments, slots 501 can comprise connecting features similar to those discussed with reference to connecting features 203.

Figure 6:
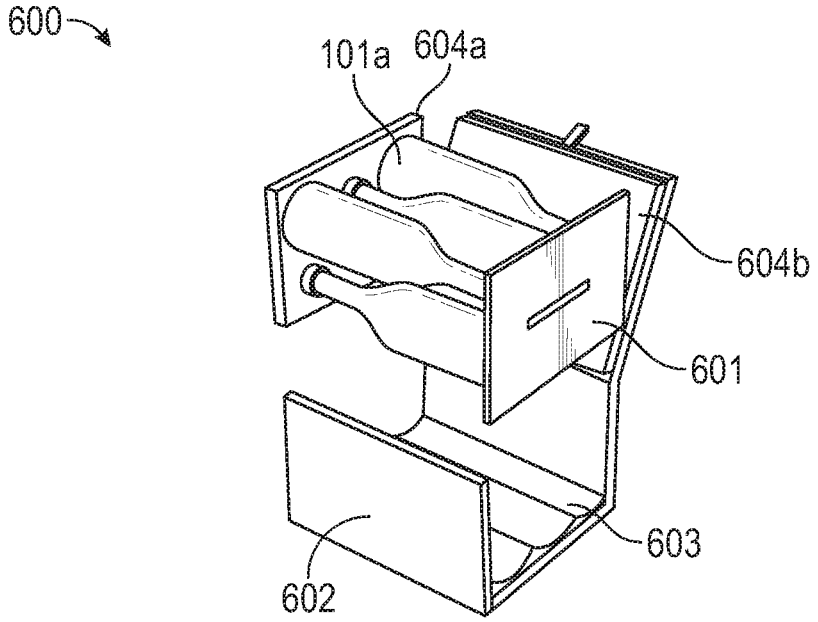
FIG. 6 is an exterior of a tamper-proof case and a contained payload surrounded by an insulating material, in accordance with an example embodiment of the presently disclosed subject matter.

FIG. 6 is a tamper-proof frame having two side panels 604*a* and 604*b* that include integrated handles 601, though it is contemplated that the handles 601 can be separate articles that are affixed to the side panels 604*a* and 604*b*. As shown in FIG. 6, holders 101*a* and 101*b* (not shown) can be affixed directly to the side panels 604*a* and 604*b*, though in some embodiments, the side panels 604*a* and 604*b* can be adapted to receive or merely abut the holders 101*a* and 101*b*. As further shown in FIG. 6, a wine case according to the present disclosure may further include a four-side enclosure 602 (or outer shell) that, combined with the side panels 604*a* and 604*b*, forms the entire exterior of the wine case. The outer shell 602 may include two integrated insulators 603 that can support and protect the wine bottles stored within the crate. The insulators 603 may be constructed from or include insulating gels or any other material for temperature control as will be appreciated by those with skill in the art. The outer shell 602 and side panels 604*a* and 604*b* can be constructed from wood or a combination of wood and plastic, cardboard, nano crystalline cellulose cardboard, PVC, rubber, metal, cork, or any other suitable material or combination of materials to provide the desired qualities described herein.

Figure 7:
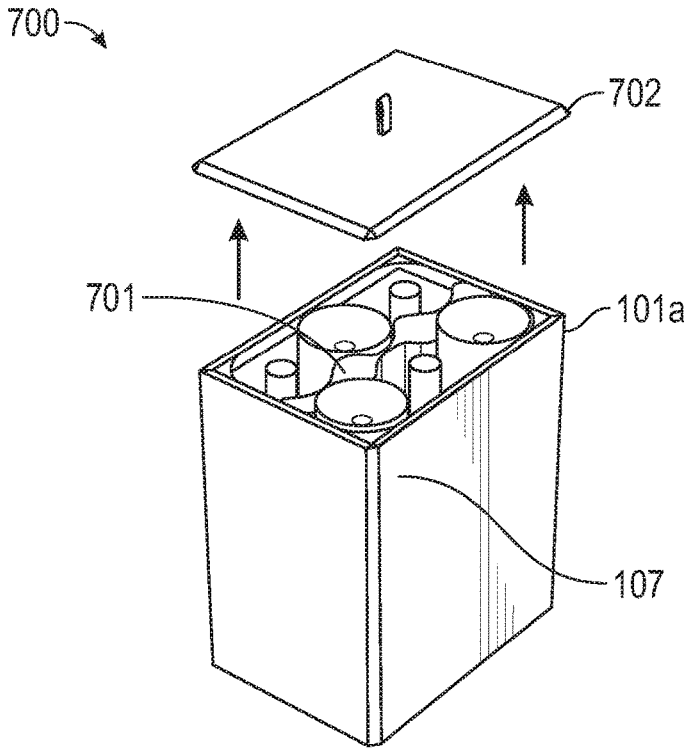
FIG. 7 is a tamper-proof case and frame with a removable lid and a contained payload surrounded by insulating material, in accordance with an example embodiment of the presently disclosed subject matter.

FIG. 7 is a tamper-proof wine case 700 wherein the holder 101*b* (not shown) is integrated into a bottom panel of the case 700 and the exterior frame 115*a* is integrated into the case's side panels. The holder 101*a* and 101*b* may be constructed from or include vine shoots, paper micro fiber cellulose, or any other material suitable for holding bottles as will be appreciated by those with skill in the art. The internal portion of the holder 101*a* (not shown), which is configured to support the necks and/or heels of the wine bottles as necessary, is integrated into the case's removable top 710. In some embodiments, and as shown, the posts 107 may be fixed at the corners of the exterior frame 115*a* and exposed on the exterior of the case 700. Some embodiments provide for insulation 701 that separates and protects bottles within the holder 101*a* and 101*b*. The insulation 701 may be integrated and shaped to fit within the case, or may be formed in separate pieces. Other embodiments may include insulation 701 or any other cooling or temperature-controlling material or device as would be appreciated by those with skill in the art. In some embodiments, insulation 701 can be provided between or around the bottles stored within the case 700 or both. As will be appreciated, it is advantageous for the insulation 701 to be shaped to fit snugly against the bottles but to allow for the placement and removal of the bottles. Accordingly, in some embodiments, the insulation 701 may either be made of a material that is capable of conforming its shape to fit within the cavity between bottles or between bottles and the interior sides of the case 700 or be made of a more rigid material that is contoured to fit within the cavity between bottles or between bottles and the interior sides of the case 700 and to allow for placement and removal of the bottles either before or after the insulation 701 is put in place. The insulation 701 may be heated or cooled to a selected storage temperature prior to placement in the case 700 and may be made of a material that is resistant to change in temperature such that its placement in close contact with a bottle will help to maintain the contents of the bottle at a desired temperature even when the exterior of the case 700 is subjected to higher or lower temperatures. In some embodiments, the case 700 may include an optional tamper feature 702 to evidence opening of the case 700. This tamper feature 702 may consist of tape or other material or device as appreciated by those with skill in the art. Additionally, some embodiments can include tamper features 702 connected to holder 101*a* or 101*b* wherein the holders 101*a* and/or 101*b* accept the neck or the heel of the bottle. In some embodiments, the tamper feature can surround each individual bottle. In other embodiments, the tamper feature may surround multiple bottles at once.

Figure 8A:
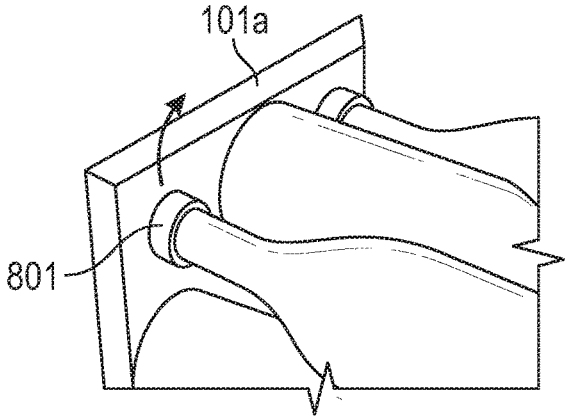
FIGS. 8A-B show a tamper-evident locking feature for securing bottles in place and that must be opened prior to removing bottles, in accordance with an example embodiment of the presently disclosed subject matter.

FIG. 8A is an integrated locking feature 801 wherein each holder (e.g., 101*a* or 101*b*) contains a locking cap for bottles to be enclosed within the locking feature 801, in accordance with an example embodiment of the presently disclosed subject matter. Some embodiments may include a holder 101*a* or 101*b* having a tamper-evident locking feature 801 configured to receive each bottle to be stored in the wine case. These locking features 801 may comprise security seals of tape, plastic, or any other material appreciated by those in the art. Other embodiments can include a locking feature configured to receive a plurality of bottles at once.

Figure 8B:
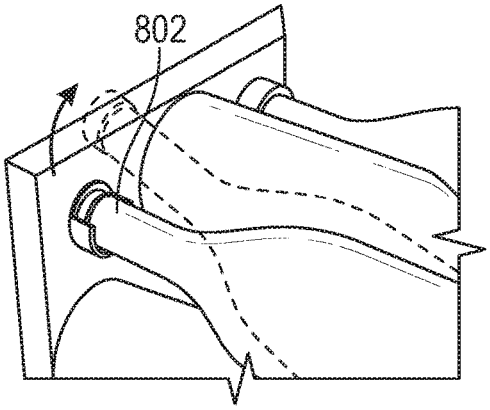

FIG. 8B is a locking feature 801 that includes a removable tamper-evident locking cap for enclosing a wine bottle, in accordance with an example embodiment of the presently disclosed subject matter. As shown in FIG. 8B, when the tamper-evident tab 801 is opened, the opening 802 allows the bottle to be removed from the locking feature 801.

Figure 9A:
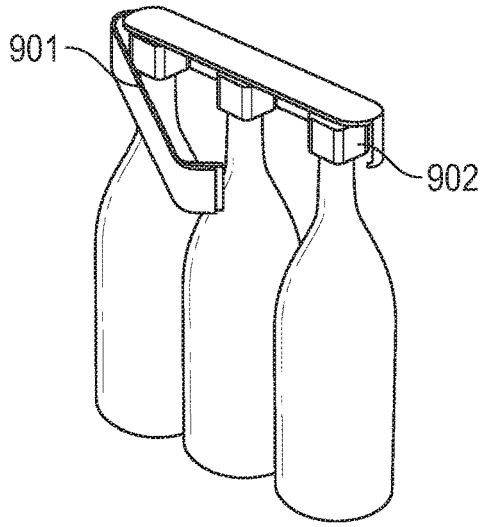
FIGS. 9A-B show a tamper-evident locking feature in which bottles are topped with a locking cap to be enclosed within the locking feature, in accordance with an example embodiment of the presently disclosed subject matter.

FIG. 9A depicts an embodiment of a tamper-evident locking feature 901 configured to receive a plurality of wine bottles. As shown, in some embodiments, individual locking caps 902 can lock the necks of individual bottles, and the locking feature 901 can secure the individual locking caps 902. In some embodiments, the locking feature 901 can include a feature for identifying tampering, such as foil, tape, or any other device or feature as appreciated by those in the art.

Figure 9B:
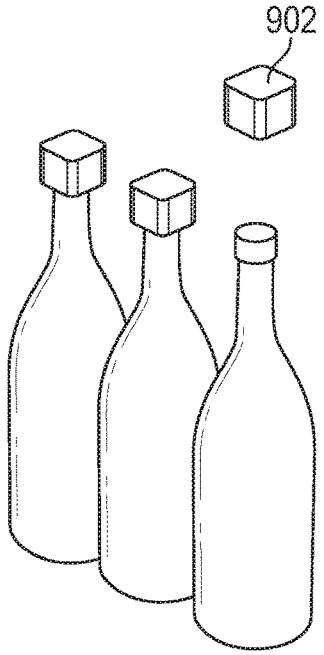

FIG. 9B depicts an embodiment where locking caps 902 may be removed from the bottle. In some embodiments, a locking cap 902 may include a GPS receiver to track the location of the bottle. In other embodiments locking caps 902 may function as a space to incorporate product-source branding.

Figure 10:
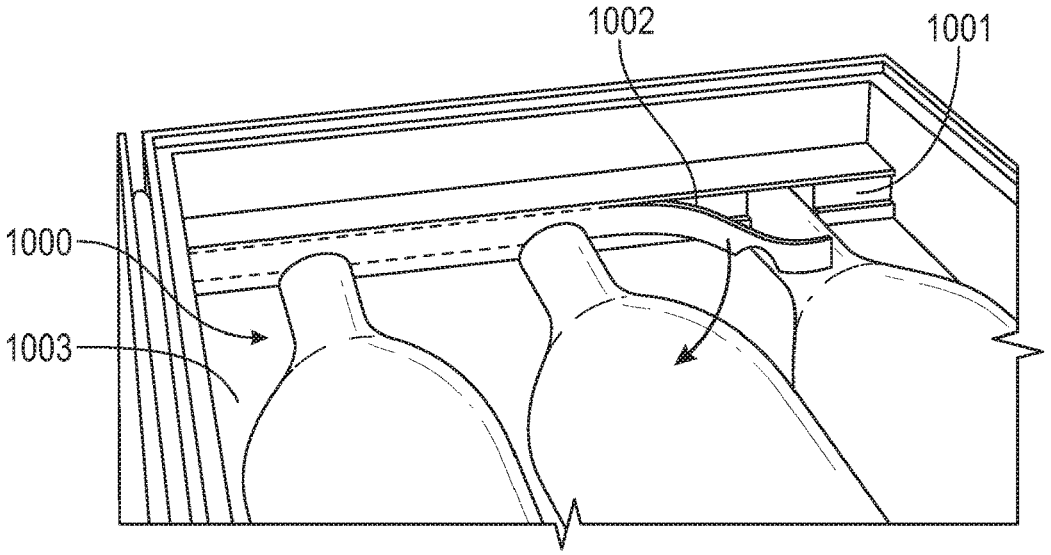
FIG. 10 is a tamper-evident strip for receiving and securing bottle necks, in accordance with an example embodiment of the presently disclosed subject matter.

FIG. 10 is a bottle arrangement wherein each arrangement comprises a strip to accept the neck of the bottle, and the strip is used as a security seal for the bottles therein, in accordance with an example embodiment of the presently disclosed subject matter. Some embodiments of a bottle arrangement 1000 include insulation 1003 around each bottle. The bottle arrangement 1000 may be configured for any number of bottles. In some embodiments, the necks of each bottle in the arrangement 1000 fit into a slot 1001 that allows the bottle to rotate in place. In other embodiments, the necks of the bottles are locked into place in slots 1001 as to prevent rotation of the bottle. In some embodiments, the slots 1001 are closed with a tamper-evident strip 1002. This strip 1002 may include security seals of tape, plastic, or any other material appreciated by those in the art. In some embodiments, once the strip 1002 is removed, the necks of the bottles are released for removal from the case 1000. Depending on desired quantity for shipment or storage, the arrangement 1000 may be stacked with multiple layers of arrangements in each case.

Figure 11A:
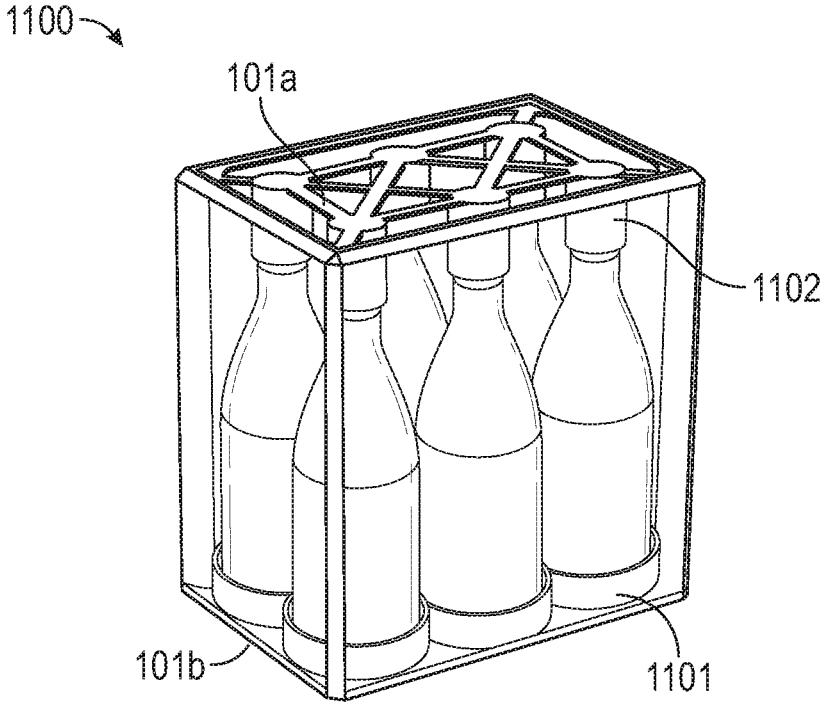
FIGS. 11A-B show a frame with bottle heel receiving cups and bottle cap receiving cups each having an integrated securing mechanism for securing the respective heel or cap, in accordance with an example embodiment of the presently disclosed subject matter.

FIG. 11A is a frame with cups 1102 and 1102 on each side of the bottle to enclose either the neck or the heel of the bottle, in accordance with an example embodiment of the presently disclosed subject matter. Some embodiments of a case 1100 comprise a bottle holder 101*a* and 101*b*, wherein each holder comprises cylindrical cups 1101 and 1102 to hold either a heel or a neck of a bottle, respectively. Other embodiments comprise alternating cup positions across holders 101*a* and holder 101*b*.

Figure 11B:
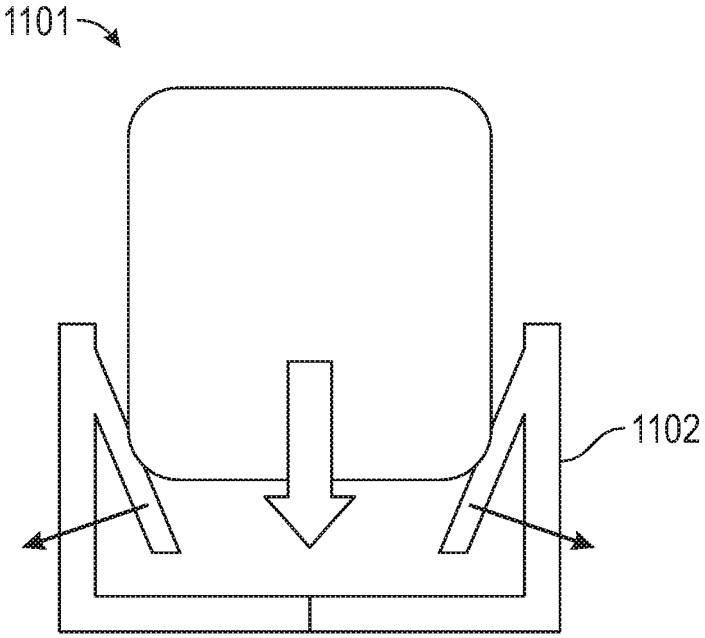

FIG. 11B is a cylindrical cup for holding the heel or neck of a bottle, in accordance with an example embodiment of the presently disclosed subject matter. In some embodiments, a cylindrical cup 1101 includes integrated fixtures 1102 that are flexible to allow the standard cup 1101 to receive and secure different bottle sizes. In other embodiments, the fixtures 1102 are not flexible but are molded to only allow a particular shape of heel or neck to be inserted into the cup 1101. In some embodiments fixtures 1102 are smooth as to allow the bottle to be rotated when enclosed in the case. In other embodiments, fixtures 1102 comprise a material providing friction as to prevent the bottles from rotating. The friction material may be selected from a rubber, silicon, or any other suitable material or combination of materials to provide the desired qualities described herein.

Figure 12:
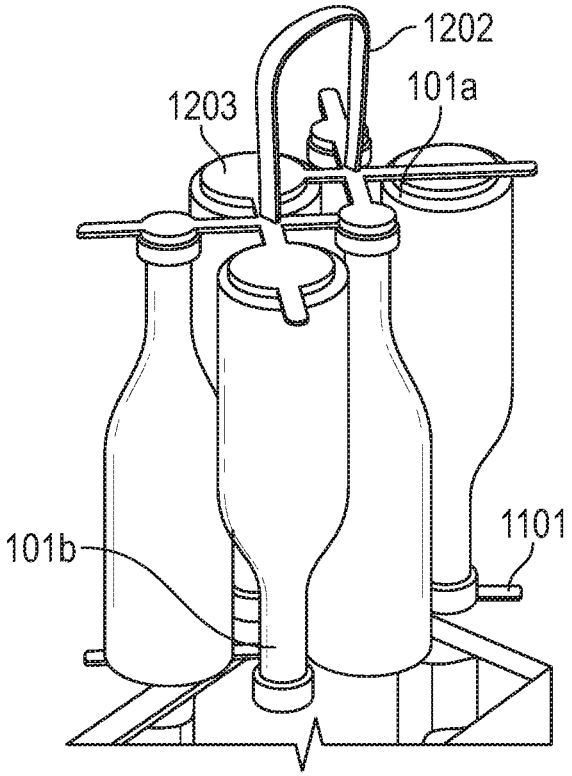
FIG. 12 is a bottle holder having convex holders to receive the concave surface of a bottle heel, in accordance with an example embodiment of the presently disclosed subject matter.

FIG. 12 is a bottle holder assembly comprising convex holders 1203 to fit the concave surface of the heel of a bottle, in accordance with an example embodiment of the presently disclosed subject matter. Some embodiments comprise a bottle holder 101*a* having a handle 1202 for removal or transport. Additionally, FIG. 12 depicts an embodiment where bottle holders 101*a* and 101*b* include alternating cups 1101 and a convex holder 1203 matching the concave surface of the heel of a bottle. Other embodiments include all cups 1101 on one bottle holder 101*a* or 101*b*, wherein the opposite holder includes entirely convex holders 1203. In these embodiments, the convex holder 1203 serves the purpose of the cups 1101 without enclosing the bottle within the cup. In some embodiments, the surface of the convex holder 1203 and the cup 1101 are smooth to allow the bottle to rotate. In other embodiments, the convex holder 1203 and the cup 1101 comprise a material providing friction as to prevent the bottles from rotating. The friction material may be selected from a rubber, silicon, or any other suitable material or combination of materials to provide the desired qualities described herein.

Figure 13A:
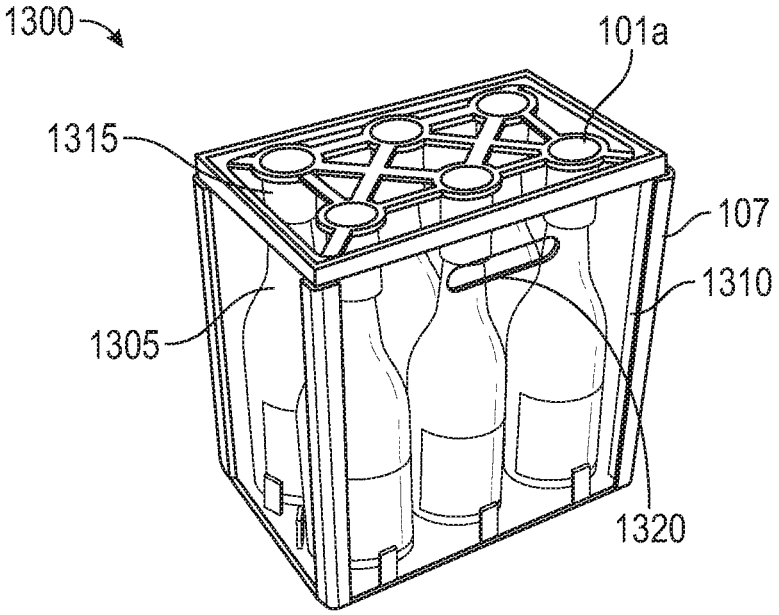
FIGS. 13A-B show a perimeter-sealed case having sealing mechanisms at each of the case's four corners, in accordance with an example embodiment of the presently disclosed subject matter.

FIG. 13A is a perimeter-sealed wine case 1300 comprising posts 107 at the four corners of the case 1300, in accordance with an example embodiment of the presently disclosed subject matter. In some embodiments, and as shown in FIG. 13A, the wide panels 1310 of the perimeter-sealed wine case 1300 can connect at posts 107. Further, side panels 1305 can connect to posts 107 such that the side panels 1305 are connected to the same post 107 as an adjacent wide panel 1310. Some embodiments can provide a connecting feature 1315 that allow for interconnection between side and/or wide panels 1305, 1310 and a top and/or bottom section (e.g. bottle holder 101*a* as shown). In some embodiments, the side panels 1305 and/or the wide panels 1310 can include handle holes 1320 or any other type of handle as would be appreciated.

Figure 13B:
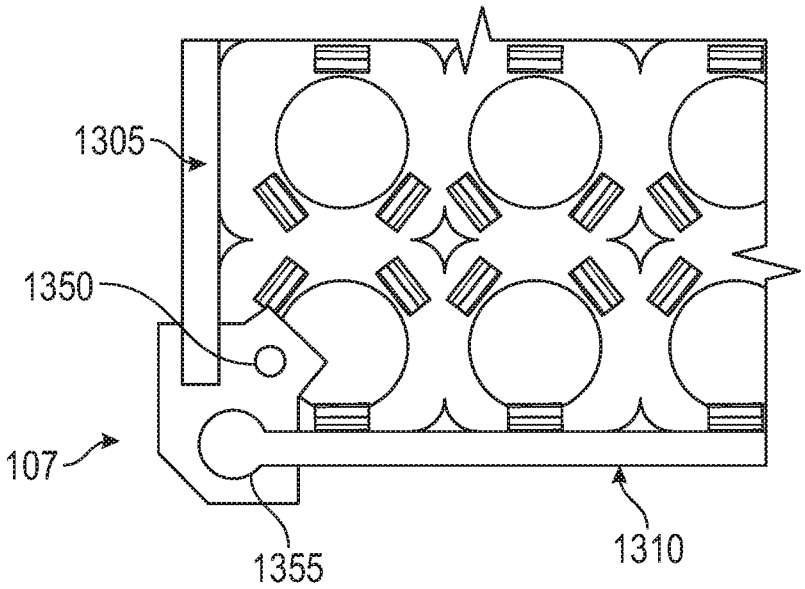

FIG. 13B is an embodiment of a post 107 configured to receive side panels 1305 and wide panels 1310 in a tongue-and-groove fashion, in accordance with an example embodiment of the presently disclosed subject matter. In some embodiments, side panels 1305 can connect to the posts 107 in a non-locking tongue-and-groove 1350. In other embodiments, the wide panels 1310 can connect to the posts 107 in a non-locking tongue-and-groove 1350. In some embodiments, both wide panels 1310 and side panels 1305 can connect to the posts 107 in a non-locking tongue-and-groove 1350. In some embodiments where a panel connects to posts 107 in a non-locking tongue-and-groove 1350, the non-locking tongue-and-groove 1350 can create an air-tight seal. In other embodiments, wide panels 1310 can connect to posts 107 with a locking groove 1355. In some embodiments, side panels 1305 can connect to posts 107 with a locking groove 1355. In another embodiment, both side panels 1305 and wide panels 1310 can connect to the same post 107 with a locking groove 1355. In some embodiments where a panel connects to posts 107 with a locking groove 1355, the locking groove 1355 can create an air-tight seal. In some embodiments the locking groove 1355 is a dovetail, wherein a panel (e.g. wide panels 1310 or side panels 1305) cannot be removed horizontally and must be removed longitudinally along the axis of the post 107. In other embodiments, the locking groove 1355 is a rounded piece on the panel such that a panel (e.g. wide panels 1310 and side panels 1305) cannot be removed horizontally and must be removed longitudinally along the axis of the post 107 (as shown in FIG. 13B). In other embodiments, the locking groove 1355 can be any other locking mechanism, as would be appreciated in the art, such that a panel (e.g. wide panels 1310 and side panels 1305) cannot be removed horizontally and must be removed longitudinally along the axis of the post 107.

Figure 14A:
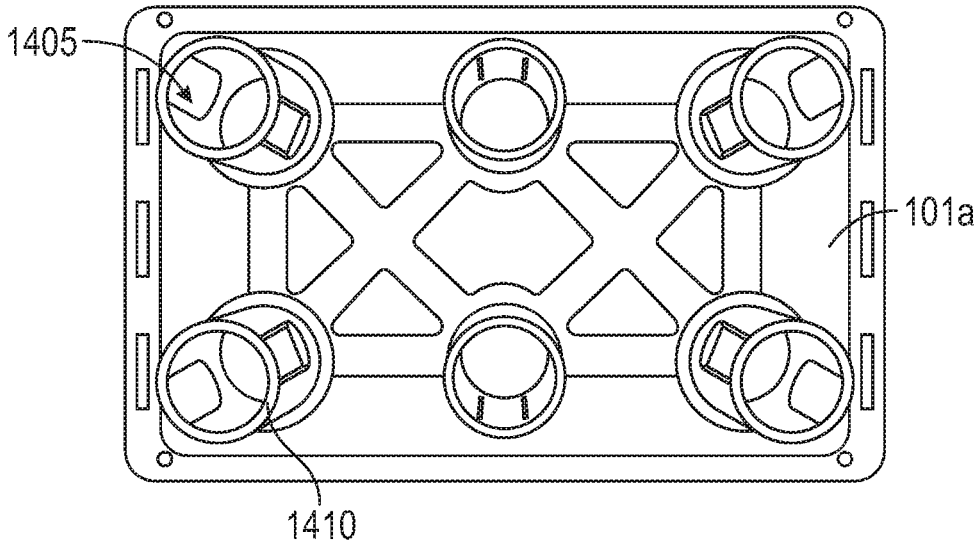
FIGS. 14A-B show an arrangement of bottle neck holders configured to receive a neck of a bottle, in accordance with an example embodiment of the presently disclosed subject matter.

FIG. 14A is a bottle engagement feature wherein neck holders 1405 provide the enclosure for a neck of a bottle, in accordance with an example embodiment of the presently disclosed subject matter. In some embodiments the neck holders 1405 can be attached to a bottle holder (e.g., bottle holder 101*b* or bottle holder 101*a*, as shown). In other embodiments the neck holders 1405 can be attached directly to a lid, top, base, or bottom of a wine case, as would be appreciated. In some embodiments, neck holders 1405 comprise neck engagement tabs 1410 wherein the neck engagement tabs 1410 lock onto the top of the neck of a bottle.

Figure 14B:
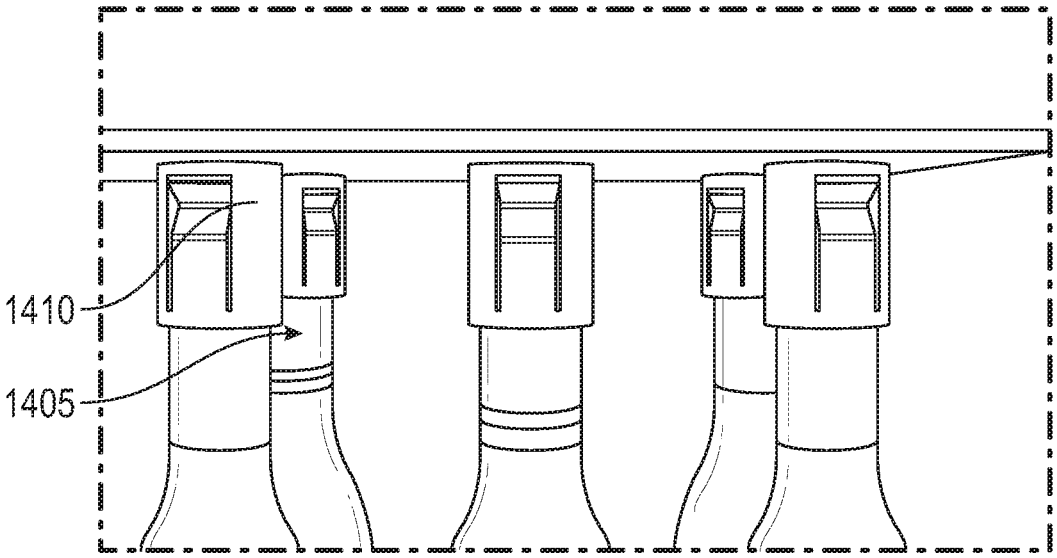

FIG. 14B depicts an embodiment in which the neck holders 1405 are attached to the neck of a bottle, in accordance with an example embodiment of the presently disclosed subject matter. In some embodiments, the neck holders 1405 contain neck engagement tabs 1410 wherein the neck of the bottle is secured within the neck holder 1405. In some embodiments, once the neck of a bottle is inserted into a neck holder 1405, the bottle cannot be removed without breaking the neck engagement tabs 1410. In other embodiments, once the neck of a bottle is inserted into the neck holder 1405, the bottle can be removed from the neck holder 1405 by applying sufficient axial force as to widen the neck engagement tabs 1410. Such embodiments would allow the neck holders 1405 to be reusable for shipping or storing subsequent bottles.

Figure 15:
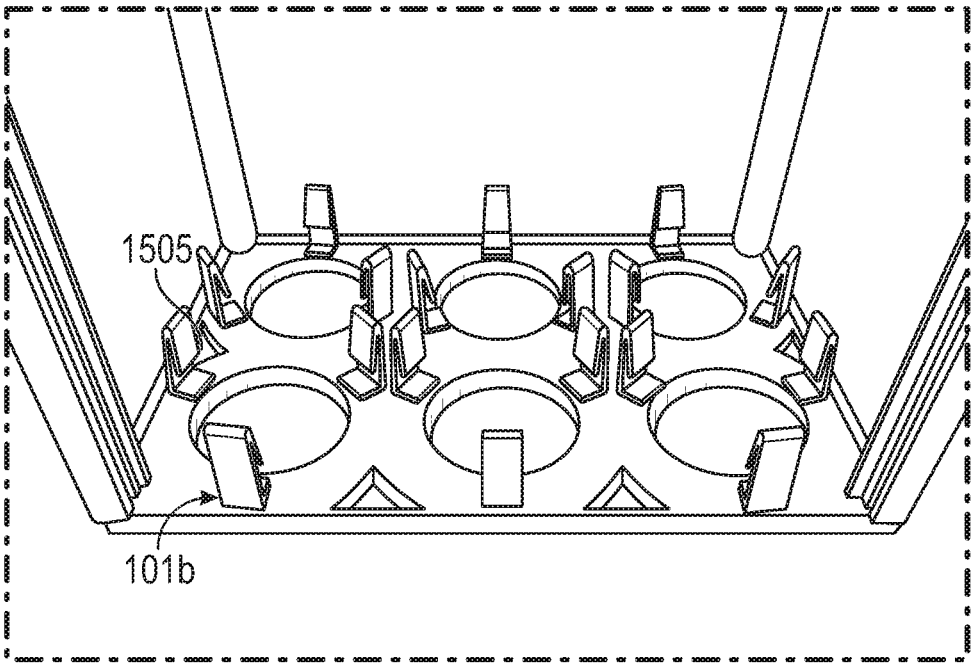
FIG. 15 is an arrangement of bottle heel holders in which the heels are secured by holding fingers, in accordance with an example embodiment of the presently disclosed subject matter.

FIG. 15 depicts a bottle heel enclosure wherein the heel of a bottle is secured by holding fingers 1505, in accordance with an example embodiment of the presently disclosed subject matter. In some embodiments, the heel of a bottle can be secured to the end of a wine case (e.g. bottle holder 101*a* or bottle holder 101*b*, as shown). In some embodiments, the bottle is secured to wine holder 101*b* with fingers 1505, wherein the fingers 1505 secure around the bottle at the heel of the bottle. In some embodiments, the fingers 1505 are flexible as to accept bottles with various widths. In some embodiments wherein the fingers 1505 are flexible, the fingers 1505 can comprise a material providing friction as to prevent the bottles from rotating. In other embodiments wherein the fingers 1505 are flexible, the fingers 1505 are not be made of a material that provides friction such that the bottles are easily rotated. In other embodiments, the fingers 1505 are not flexible yet the fingers 1505 comprise padding such that the bottles may be inserted into the padding of the fingers 1505.

Figure 16:
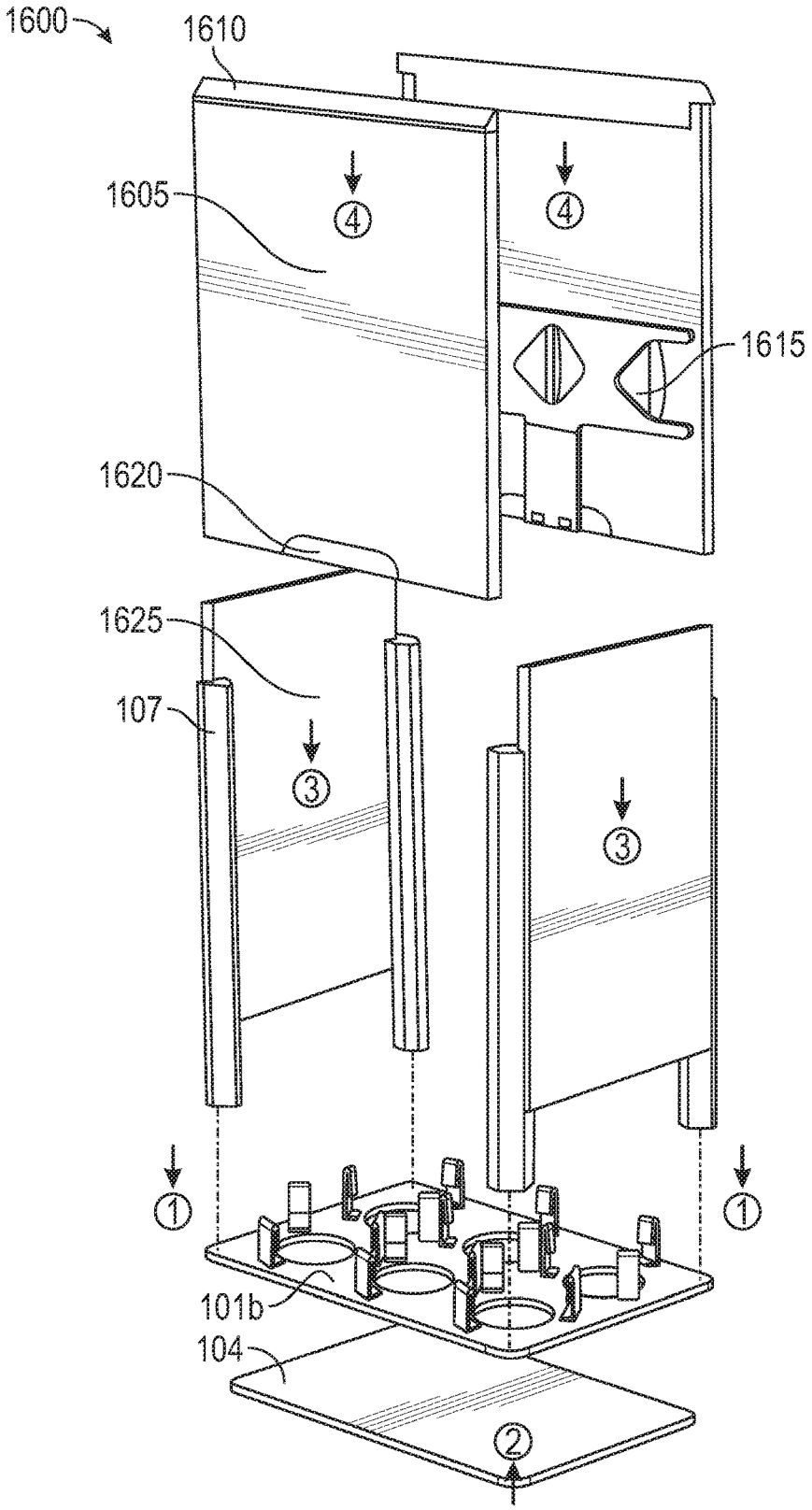
FIG. 16 shows an assembly of a tamper-proof case, in accordance with an example embodiment of the presently disclosed subject matter.

FIG. 16 shows an assembly of a tamper-proof case 1600, in accordance with an example embodiment of the presently disclosed subject matter. In some embodiments, and as shown, one or more racking stability tabs 1615 are attached to the rear side of the wide panel, or observation panel 1605. As will be appreciated, the racking stability tabs 1615 can limit the movement of the bottles within the tamper-proof wine case. Additionally, an insert shaped to fit between six bottles can be included to further limit the movement of the bottles within the case. In some embodiments, wide panels 1605 may include a lock/unlock door release 1620 near the bottom of the panel, and a door chamfer 1610 near the top of the panel. The door chamfer 1610 can connect with the top of post 107 to provide a seamless fit around the perimeter of the tamper-proof wine case 1600.

In some embodiments, side panels 1625 and wide panels 1605 of the tamper-proof wine case 1600 can connect to the breakaway frame 110 (not shown) by sliding into posts 107. Further, and as shown, side panels 1625 can be connected to the same post 107 as the adjacent wide panel 1605. In some embodiments, the posts 107 can connect to the bottle holder 101*b* with insertable plastic screws, zip tie snapping, or other connecting mechanisms. In other embodiments, the bottle holder 101*b* may be attached to the base 104.

Figure 17A:
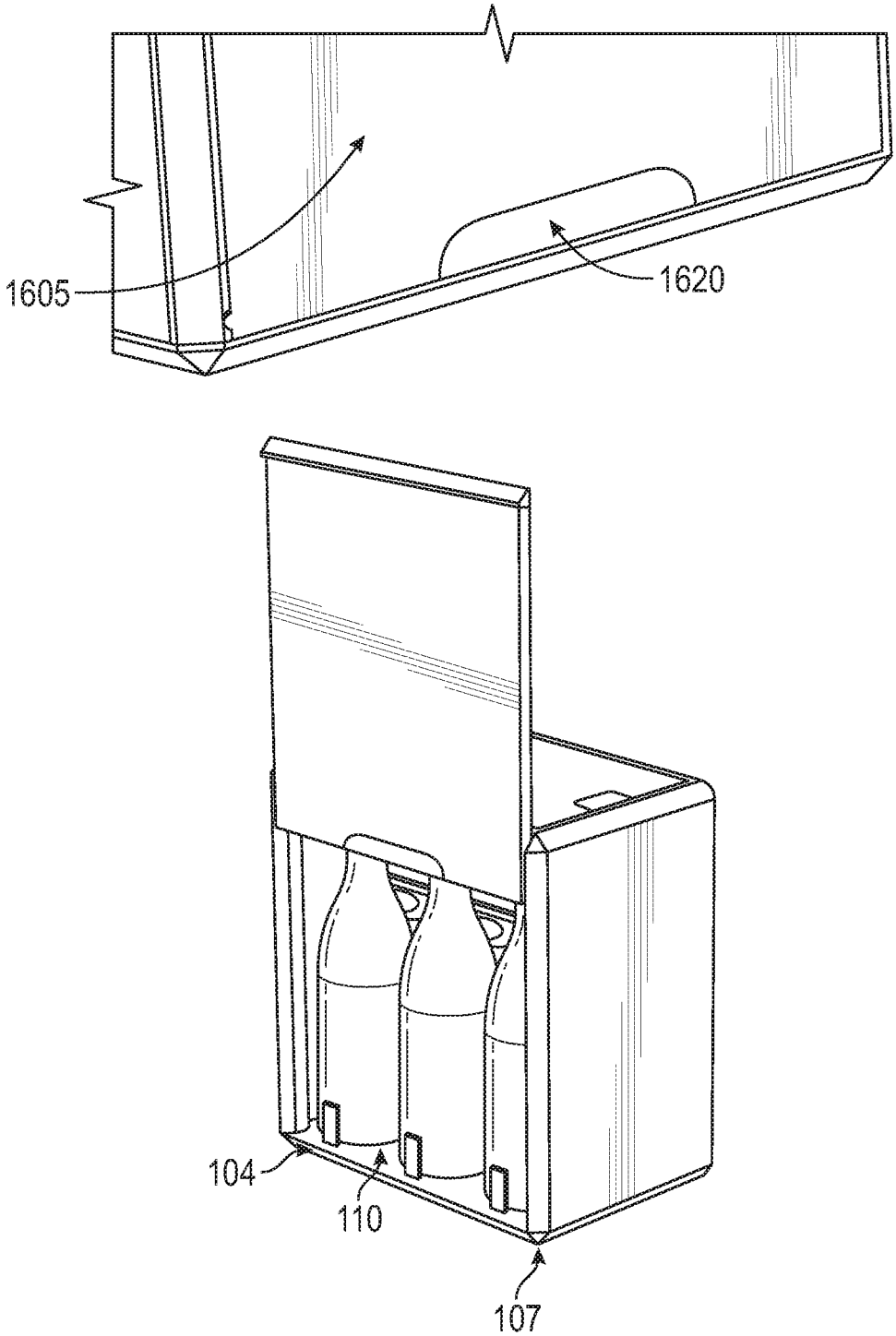
FIGS. 17A-B show an inspection sliding door with a detailed view of an inspection release button, in accordance with an example embodiment of the presently disclosed subject matter.

FIG. 17A is a wide panel door 1605 with an inspection release button 1620, in accordance with an example embodiment of the presently disclosed subject matter. In some embodiments, and as shown, wide panels 1605 may provide enclosure of the tamper-proof case 1600 by sliding downward between posts 107. In some embodiments, when wide panels 1605 slide completely downward, the inspection release button 1620 may latch onto the breakaway frame 110 or the base 104, providing a locking feature. Conversely, in some embodiments, the inspection release button 1705 can be unlocked by releasing the inspection release button 1705 when it is attached to the breakaway frame 110 or the base 104.

Figure 17B:
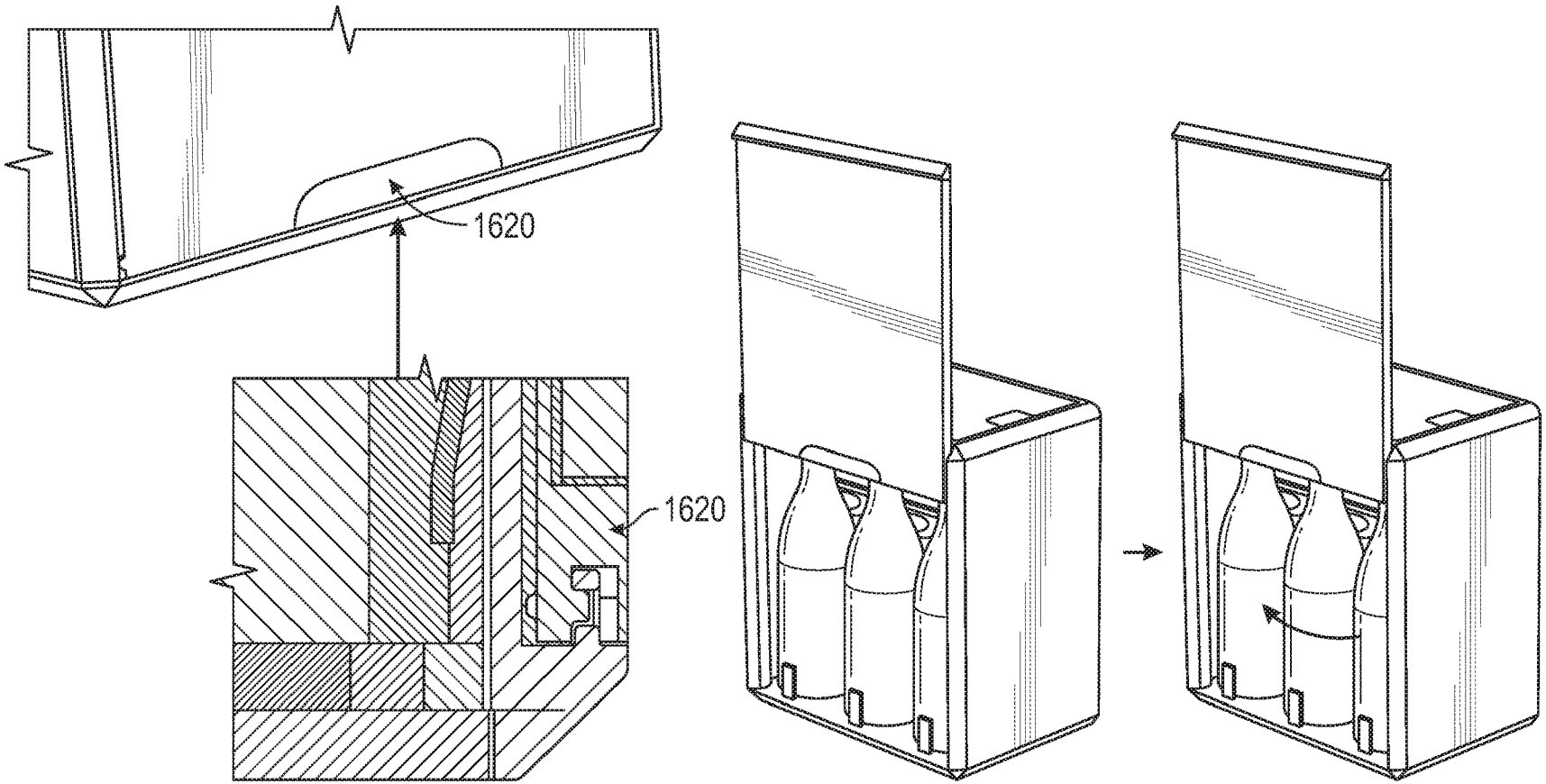

FIG. 17B is a detailed view of a wide panel 1605 with an inspection release button 1620, in accordance with an example embodiment of the presently disclosed subject matter. As will be appreciated, the sliding door feature with an inspection release button can allow a customer, seller of wine, or any other person using the tamper-proof wine case to open and close the wine case without compromising the integrity of the packaging. Further, the previously mentioned feature allows inspection of the bottles while they are within the tamper-proof case. Thus, for example, someone can inspect the bottles within the case (e.g., view the label, rotate the bottle, etc.), but subsequent users can be assured that the bottles originally in the case remain in the case.

Figure 18A:
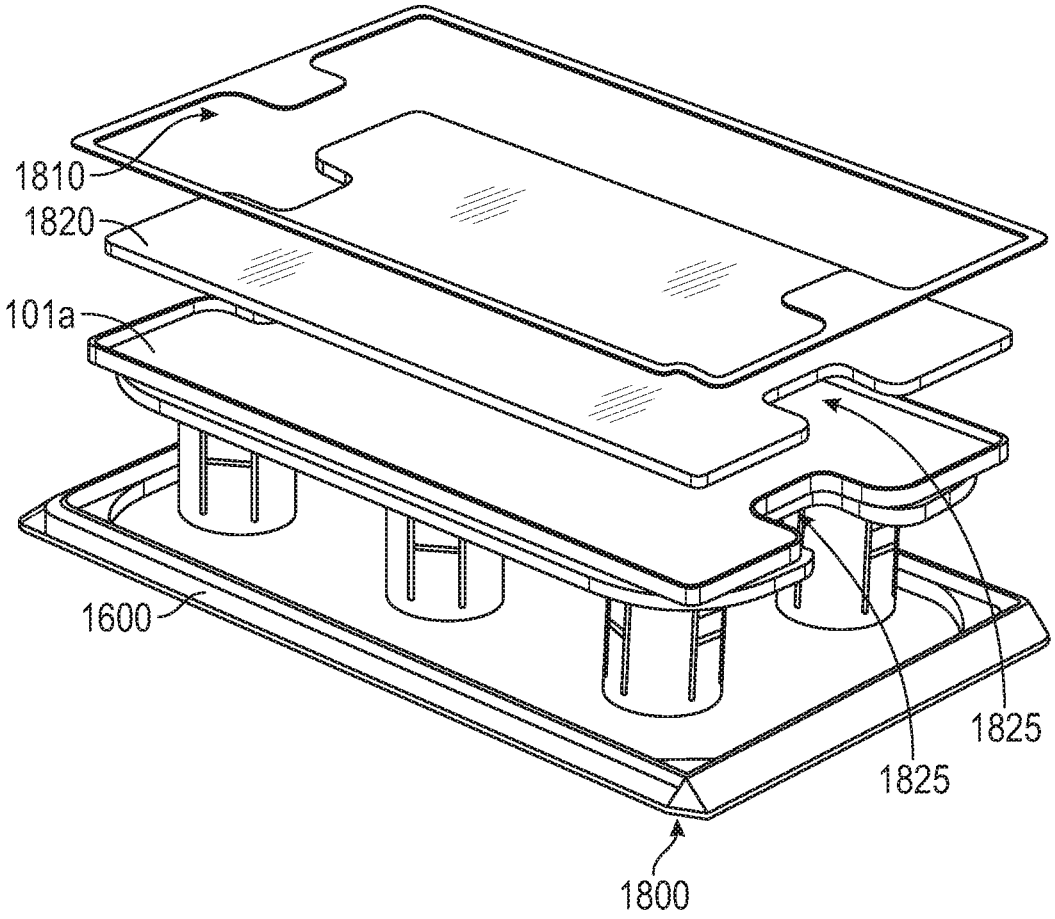
FIGS. 18A-C show use of a security lid with a pull tab in accordance with an example embodiment of the presently disclosed subject matter.

FIG. 18A depicts a security lid 1800 that comprises security seal 1810, top panel 1820 having string device 1830 and discussed further herein, and bottle holder 101*a*, in accordance with an example embodiment of the presently disclosed subject matter. In some embodiments, the security lid 1800 can provide enclosure of the top portion of the tamper-proof case 1600. In some embodiments, and as shown, bottle holder 101*a* can be positioned as the bottom-most portion of security lid 1800. The bottle holder 101*a*, top panel 1820, and security seal 1810 can each fit together based on each layer decreasing in size as the layers go from top to bottom. In some embodiments, top panel 1820 has finger grooves 1825 and is positioned above bottle holder 101*a*. In some embodiments, and as shown, bottle holder 101*a* has finger grooves 1825 and is positioned above top portion of the tamper-proof case 1600. In some embodiments, and as shown, security seal 1810 is positioned around the perimeter of the security lid 1800. Top panel 1815 may be made of similar material to that used for construction of side panel 1625.

Figure 18B:
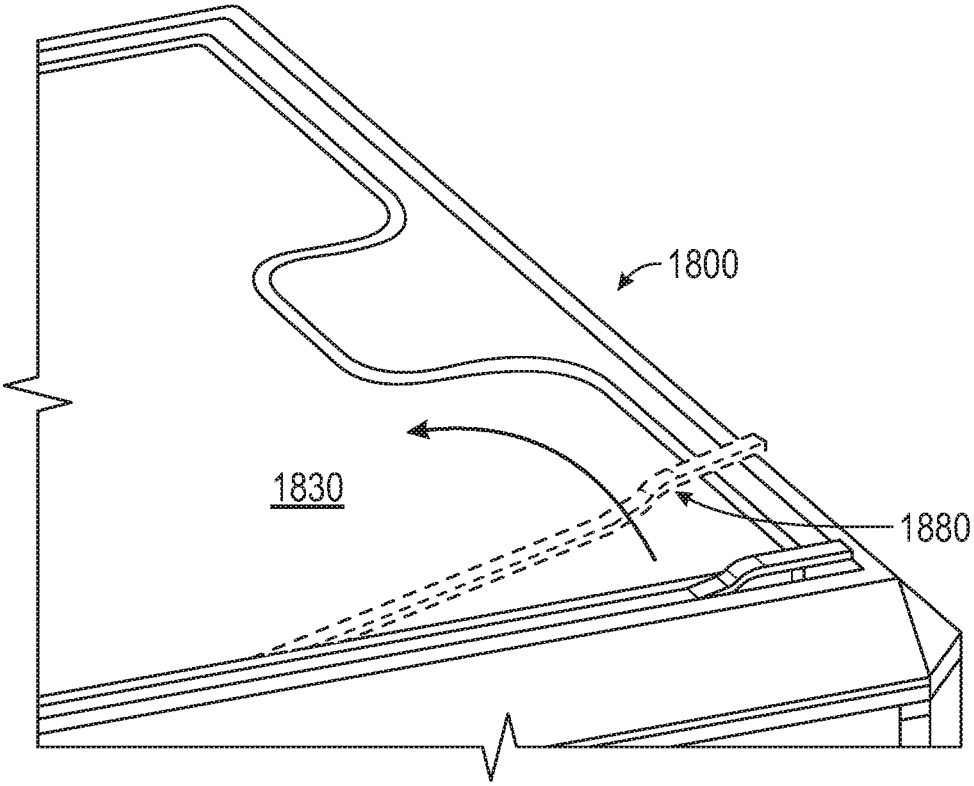

FIG. 18B is a detailed view demonstrating the detachment of a removable pull tab and string devices 1830 from a security lid 1800. As shown, the main seal 1820 can include one or more integrated, removable pull tab and string devices 1830. In some embodiments, when a user pulls the removable pull tab and string 1830, it releases the main seal 1820 from the main lid 1805, exposing finger grooves 1825 below. As will be appreciated, by including a tamper-proof seal, shippers and recipients can be assured that the contents inside the tamper-proof case 1600 have not been disturbed.

Figure 18C:
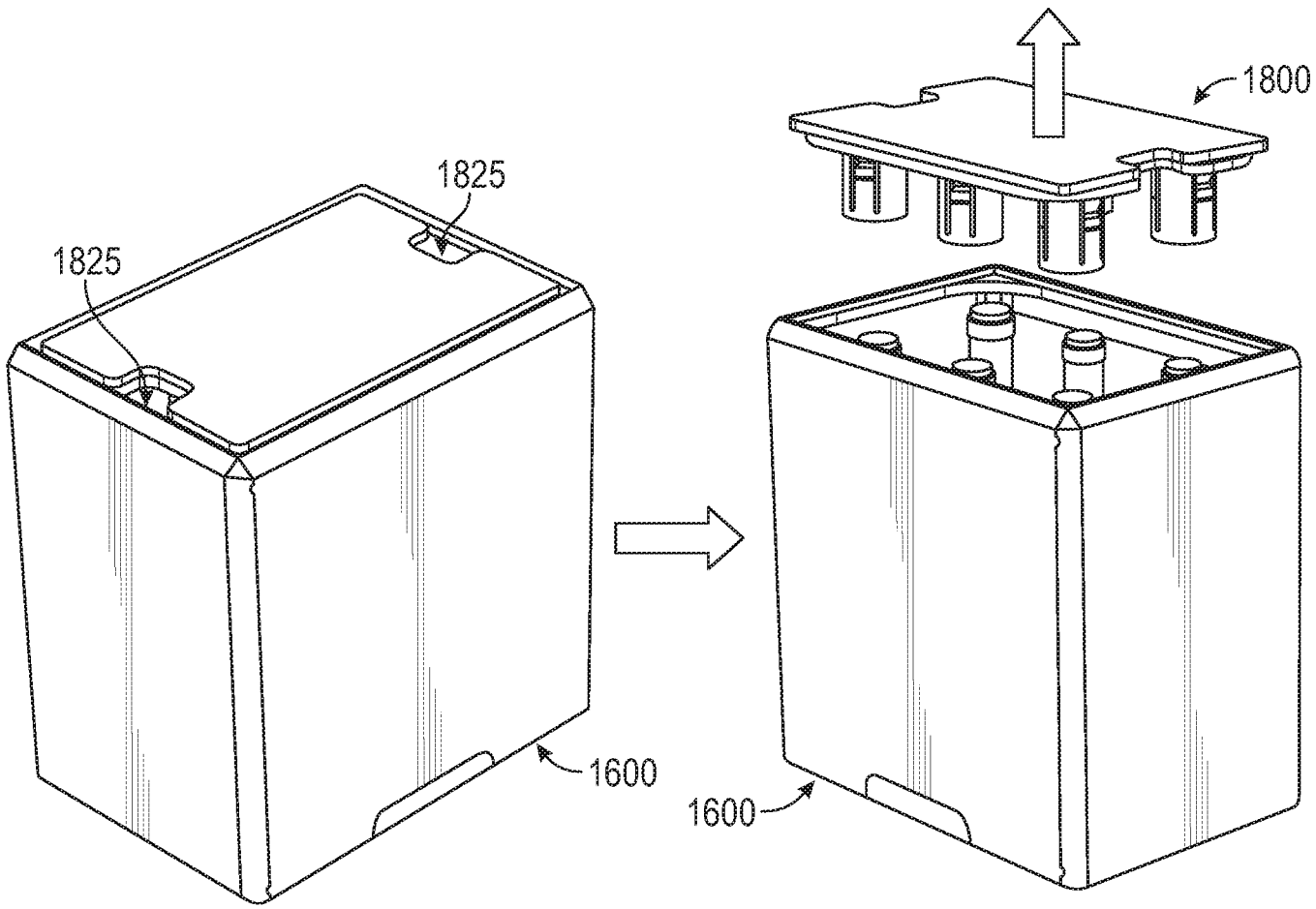

FIG. 18C shows the removal of a security lid 1800 using the finger grooves 1825, in accordance with an example embodiment of the presently disclosed subject matter. As shown, once the main seal 1820 has been released and removed from the main lid 1805, the accessible finger grooves 1825 allow the user to easily grip and remove the security lid 1800, thus providing access to the contents of the tamper-proof case 1600.

Figure 19:
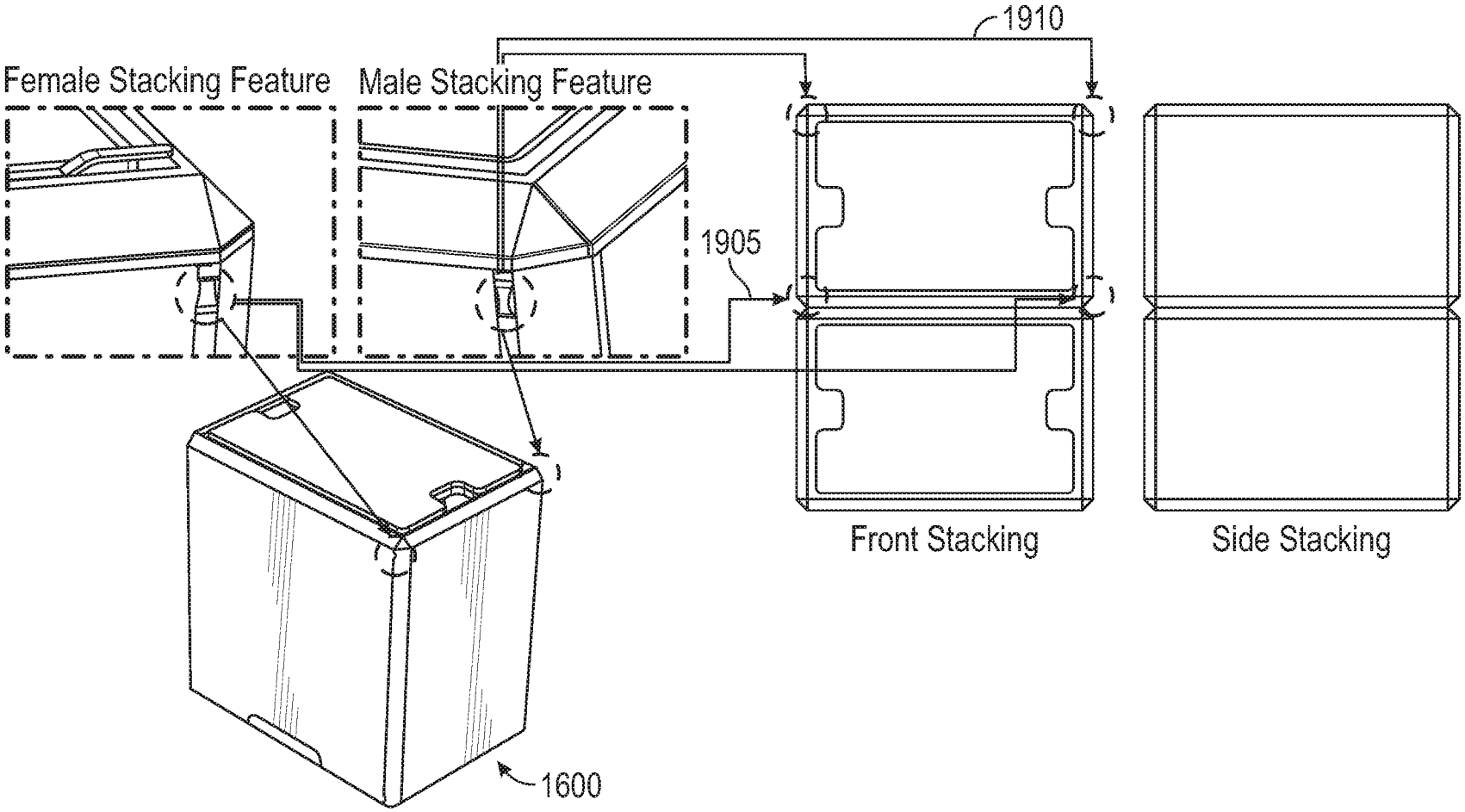
FIG. 19 shows a stacking of multiple tamper-proof cases, in accordance with an example embodiment of the presently disclosed subject matter.

FIG. 19 shows how multiple units (i.e., cases of the present disclosure) can stack together, in accordance with an example embodiment of the presently disclosed subject matter. In some embodiments, and as shown, the tamper-proof wine case has a female stacking feature 1905 and a male stacking feature 1910. In some embodiments, the post 107 has either a female stacking feature 1905 or a male stacking feature 1910 toward the top of the tamper-proof wine case 1900. Additionally, in some embodiments, and as shown, the female stacking feature 1905 and the male stacking feature 1910 can interlock together, which allows tamper-proof wine cases to be stacked in an arrangement such that the enclosed bottles are stored horizontally or in an arrangement such that the enclosed bottles are stored vertically. Accordingly, cases in a single horizontal layer can be interlocked, and cases stacked vertically can be interlocked. Additionally, as will be appreciated, cases can be interlocked both horizontally and vertically to provide a three-dimensional interlocked collection of cases.

Figure 20A:
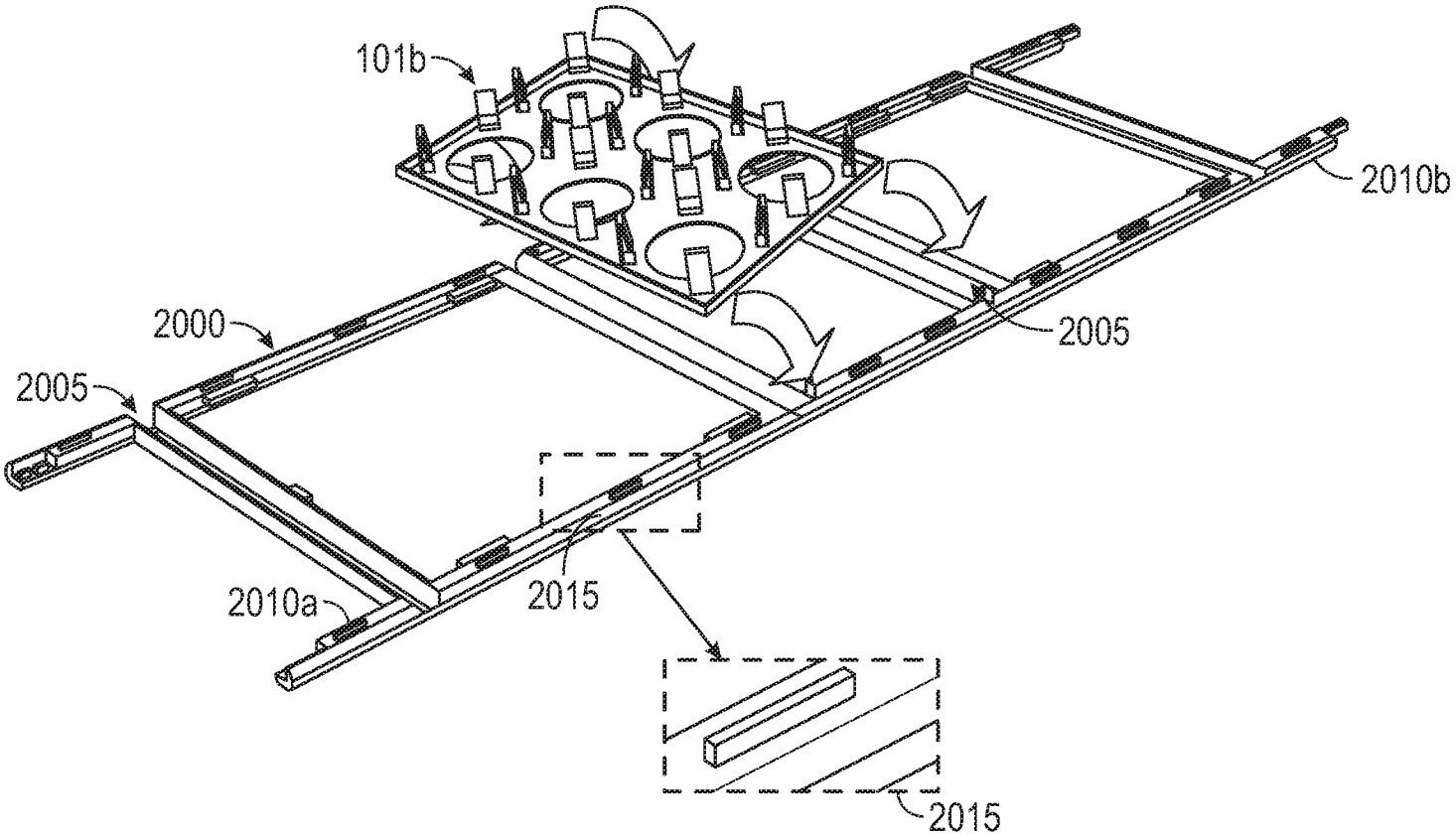
FIGS. 20A-F show the assembly of a tamper-proof case comprising a frame having various living hinges, in accordance with an example embodiment of the presently disclosed subject matter.

FIG. 20A shows a frame 2000 for a tamper-proof case having various living hinges 2005 prior to assembly, in accordance with an example embodiment of the presently disclosed subject matter. The living hinge frame 2000 may be composed of plastic, PVC, or any other material or combination of materials to provide the desired qualities described herein. In some embodiments, and as shown, the living hinge frame 2000 contains one or more living hinges 2005. In some embodiments, and as will be understood by one of skill in the art, living hinge 2005 may be a thin piece or portion of the living hinge frame 2000 designed to allow the living hinge frame 2000 to fold along the living hinge 2005. According to some embodiments, as shown, living hinge 2005 may be positioned so as to allow the living hinge frame 2000 to be folded into a desired position. For example, in some embodiments, and as will be further illustrated in FIGS. 20B and 20C, living hinge frame 2000 may be folded at each living hinge 2005 to form a cube or box structure.

In some embodiments, and as shown, living hinge frame 2000 can contain one or more tabs 2015. As may be appreciated, the tabs 2015 provide for attachment of the side panels 1625 (not shown). In some embodiments, tabs 2015 may be molded projections integrally formed with the living hinge frame 2000. According to some embodiments, tabs 2015 may be projections affixed to the living hinge frame 2000. In some embodiments, tabs 2015 may be serrated, and as will be appreciated such serrated features of the tabs 2015 may further improve the connection at the joint between the side panels 1625 and the living hinged frame 2000.

As further shown in FIG. 20A, some embodiments may include a bottle holder 101*b*, as previously discussed. According to some embodiments, prior to folding the living hinge frame 2000, bottle holder 101*b* can be attached to the living hinge frame 2000. In some embodiments, bottle holder 101*b* may snap into place into the living hinge frame 2000. For example, in some embodiments, living hinge frame 2000 may have a frame pocket 2050 with snap in features on one or more sides configured to receive bottle holder 101*b*. In some embodiments, bottle holder 101*b* may be press fit into a frame pocket in the living hinge frame 2000. In alternate embodiments, instead of bottle holder 101*b*, a flat panel may be attached to living hinge frame 2000 to create a container suitable for storing or transporting, for example, cigars, jewelry, and the like. In other embodiments and as discussed in further detail with reference to FIG. 21A, bottle holder 101*b* may be integrally formed with living hinge frame 2000. Living hinge frame 2000 also may comprise symmetric top lid frame portions, or edge attachment arms 2010*a* and 2010*b*. For example, upon folding living hinge frame 2000, symmetric top lid frame portions 2010*a* and 2010*b* may connect to form the top surface, as discussed further herein.

Figure 20B:
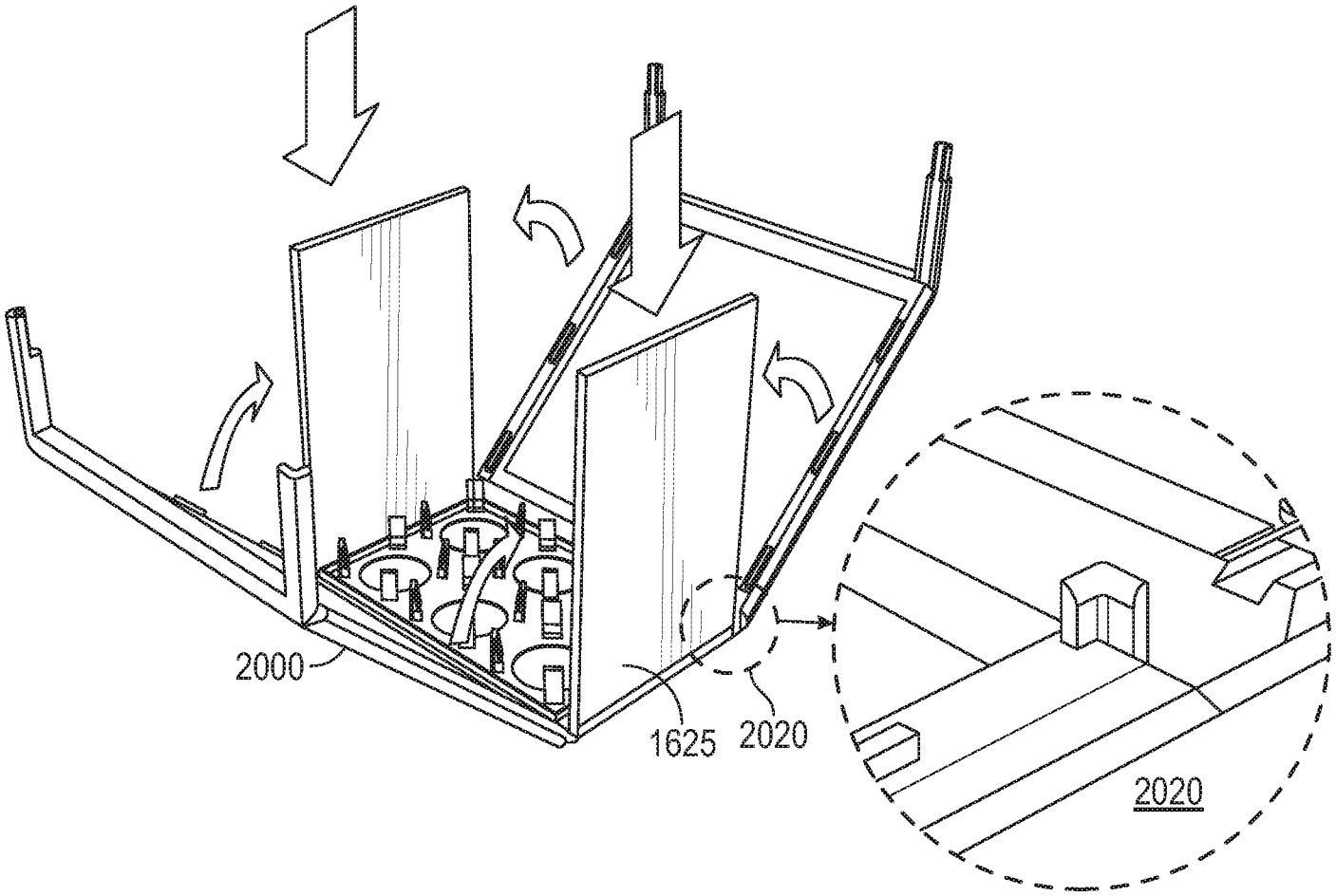

FIG. 20B shows a partially assembled tamper-proof case having a frame 2000 comprising various living hinges 2005, in accordance with an example embodiment of the presently disclosed subject matter. In some embodiments, and as shown, the tamper-proof case may include side panels 1625. Side panels 1625 may be composed of wood (pine or otherwise), a rigid card stock, pressed card stock on either side of an insulating material, plastic, PVC, metal, rubber, or any other material or combination of materials to provide the desired qualities described herein. In some embodiments, the bottom edge of side panels 1625 may have one or more slots (not shown) for receiving a tab 2015 to secure the side panel 1625 to the living hinge frame 2000, as discussed further herein. In some embodiments, slots may be portions of the side panel 1625 that are cut out or otherwise configured to receive a portion of the living hinge frame 2000. According to some embodiments, and as will be appreciated by one of skill in the art, slots may be formed in the fashion of a mortise and tenan joint or any other suitable formation that would allow for connection to be made between the side panel 1625 and the living hinge frame 2000.

In some embodiments, and as shown, the bottom of the living hinge frame 2000 can include guiding tabs 2020, which may be molded projections integrally formed with the living hinge frame 2000 or projections affixed to the living hinge frame 2000. As will be appreciated, guiding tabs 2020 may provide a locating feature, indicating the location that side panels 1625 are to be connected with the living hinge frame 2000. In some embodiments, and as shown, side panels 1625 may be placed within the living hinge frame 2000 by inserting side panels 1625 flush against the guiding tabs 2020. Further, in some embodiments, tabs 2015 may penetrate the bottom slots of side panels 1625, allowing attachment of side panels 1625 to the bottom of the living hinge frame 2000.

Additionally, as shown in FIG. 20B, living hinge frame 2000 may have living hinges 2005 positioned on both sides of the bottle holder 101*b*. As will be appreciated, such positioning of the living hinges 2005 may allow for the sides of the living hinge frame 2005 to be folded upwards towards the side panels 1605. Side edges of side panels 1625 may connect to the living hinge frame 2000 in a similar manner to the bottom edges of side panels 1625 as discussed above. For example, side edges of side panels 1625 may have one or more slots (not shown) and the living hinge frame 2000 may have one or more tabs 2015 corresponding to the one or slots. Accordingly, when the living hinge frame is folded about the living hinges 2005, the one or more tabs on the living hinge frame 2000 may contact or engage the or more slots on the side edges of the side panels 1625 in a manner similar to how tabs 2015 contact or engage the bottom edge of side panels 1625. Accordingly, in such embodiments and as will be appreciated, side panels 1625 may be attached to living hinge frame 2000 both at the bottom portion and side portions without the use of nails, glue, or other adherents. While the disclosed subject matter has been described in terms of specific positioning of living hinges 2005, it is understood that the position described is chosen in order to achieve a specific shape of the final tamper-proof case. Accordingly, other positioning is contemplated in order to achieve the desired size and shape of the tamper-proof case.

Figure 20C:
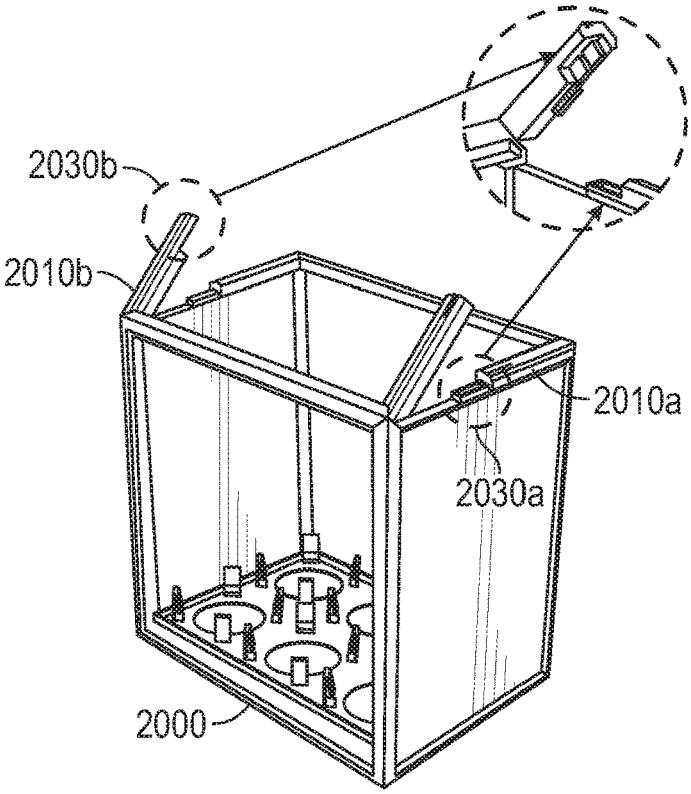

FIG. 20C shows further assembly of tamper-proof case having a frame 2000 comprising various living hinges 2005, in accordance with an example embodiment of the presently disclosed subject matter. As previously discussed, in some embodiments, upon folding the living hinge frame 2000, symmetric top lid frame portions 2010*a* and 2010*b* may connect to form the top surface of living hinge frame 2000. In such embodiments, top lid frame portions 2010*a* and 2010*b* may connect to living hinge frame 2000 through living hinges 2005 positioned at an end of the top lid frame portions 2010*a* and 2010*b*. For example, living hinges 205 may allow living hinge frame 2000 to be folded at the edge of each top lid frame portion 2010*a* and 2010*b* such that top lid frame portions 2010*a* and 2010*b* may be folded towards each other in order to connect and form the top surface of the living hinge frame 2000. In some embodiments, the top edges of side panels 1625 may have one or more slots (not shown) and the top lid frame portions 2010*a* and 2010*b* may contain may have one or more tabs 2015 corresponding to the one or slots. According to such an embodiment, for example, when the living hinge frame is folded about the living hinges 2005, the one or more tabs 2015 on the top lid frame portions 2010*a* and 2010*b* may contact or be received by the or more slots on the top edge of the side panels 1625 in a manner as previously discussed in regard to FIGS. 20A and 20B.

Additionally, in some embodiments, top lid frame portions 2010*a* and 2010*b* may each contain male fastener or locking mechanism 2030*a* and a female fastener or locking mechanism 2030*b*. Thus, after the living hinge frame 2000 has been folded, the male fastener 2030*a* may latch with the female fastener 2030*b*, forming the top surface of the living hinge frame 2000 and locking the frame 2000 in place. As will be appreciated, the locking feature provided by the male fastener 2030*a* and the female fastener 2000*b* allow the frame to lock without compromising the living hinge frame 2000. In some embodiments, the male fastener 2030*a* and female fastener 2030*b* are inaccessible once the living hinge frame 2000 is fully assembled. According to some embodiments, the male fastener 2030*a* and female fastener 2030*b* are snap tap fasteners, however, any other type of suitable fastener may be used. Further, in some embodiments, the first According to some embodiments, after the live-hinge frame 2000 is locked in place the bottles are placed into the tamper-proof case by way of the bottle holder 101*b* as previously discussed.

Figure 20D:
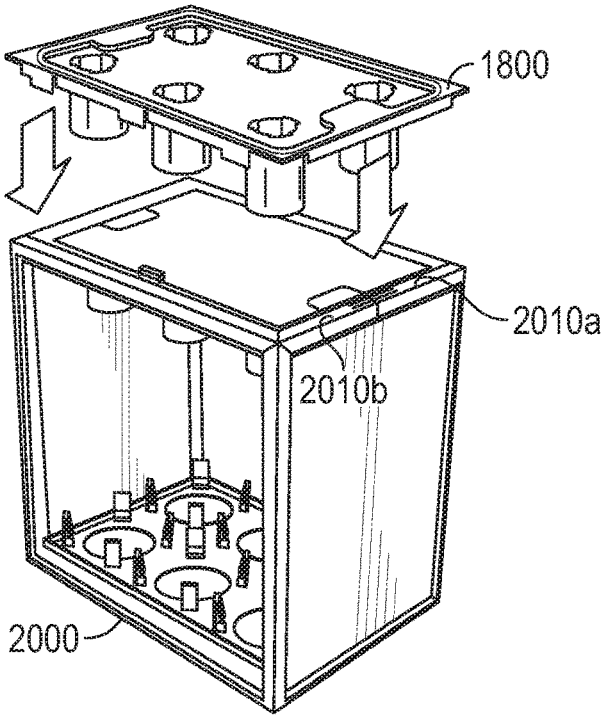

As shown in FIG. 20D, after the living hinge frame 2000 is locked in place, security lid 1800, as previously discussed with reference to FIG. 18A, may be inserted down into the living hinge frame 2000, according to some embodiments. As previously discussed, security lid 1800 may comprise security seal 1810, top panel 1820, and bottle holder 101*a*. According to some embodiments, bottle holder 101*a* may downwardly insert into the top of the living hinge frame 2000 on top of the bottles. In some embodiments, top panel 1820 may insert on top of the bottle holder 101*a* and security seal 1810 may insert on top of top panel 1820. In some embodiments, bottle holder 101*a*, top panel 1820, and security seal 1810 can each fit together based on each layer decreasing in size as the layers go from top to bottom, and once in place, fasteners 2030*a* and 2030*b* lock the security lid onto the top of the living hinge frame 2000. Additionally, in some embodiments, security lid 1800 may comprise a removable pull tab 1880, as referenced in FIG. 18B. As previously discussed, when a user pulls the removable pull tab 1880, such action may release the security seal 1810 from the security lid 1800, such that the security lid 1800 may be opened along a hinged edge or removed completely from the living hinge frame 2000.

Figure 20E:
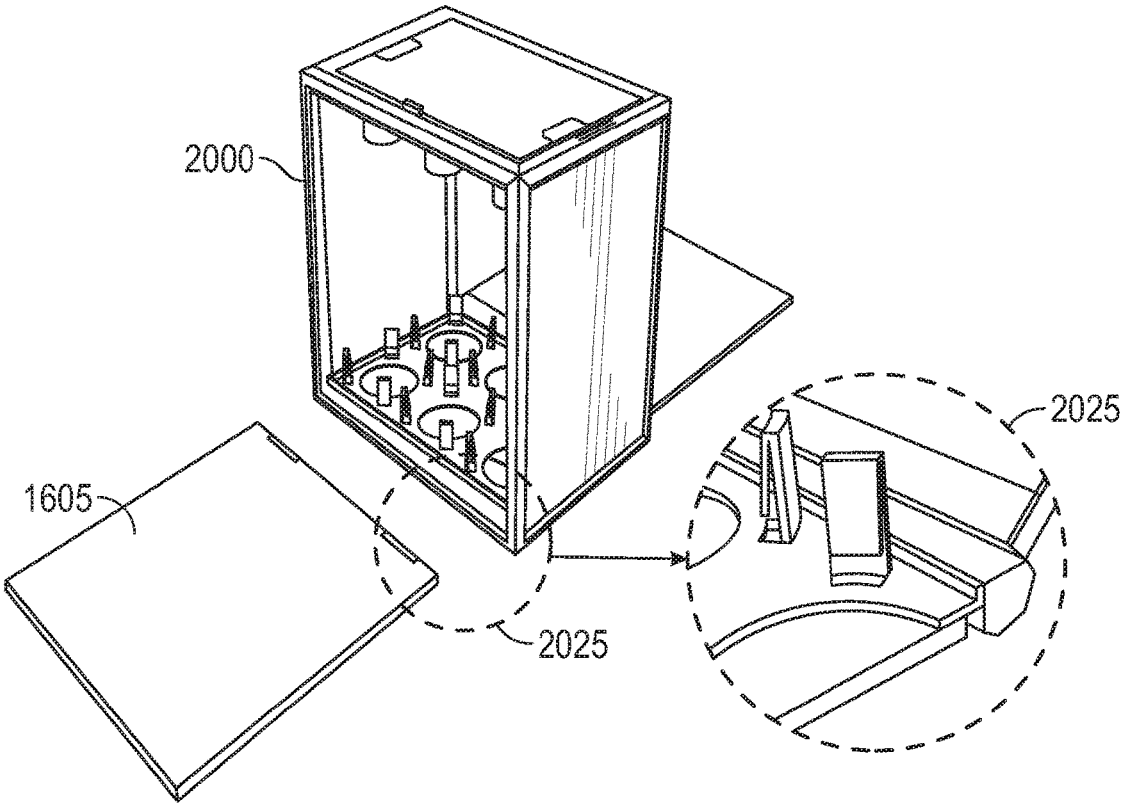

FIG. 20E shows further assembly of tamper-proof case having a frame 2000 comprising various living hinges 2005, in accordance with an example embodiment of the presently disclosed subject matter. In some embodiments, bottom of the living hinge frame 2000 may contain living hinge tabs 2025, which may be thin pieces or portions of the living hinge frame 2000 designed to allow the living hinge frame 2000 to fold along the living hinge tabs 2025. In some embodiments, as previously discussed, living hinge frame 2000 may comprise tabs 2015 which may be molded projections integrally formed with or projections affixed to living hinge frame 2000.

According to some embodiments, living hinge tabs 2025 may provide a locating feature, indicating the location that observation panels 1605 are to be connected with the living hinge frame 2000. As with side panels 1625, observation panels 1605 may be composed of wood (pine or otherwise), some sort of rigid card, pressed card on either side of an insulating material, plastic, PVC, metal, rubber, or any other material or combination of materials to provide the desired qualities described herein. In some embodiments, and as shown, observation panels 1605 may be placed within the living hinge frame 2000 by inserting observation panels 1605 flush against the living hinge tabs 2025. In some embodiments, the bottom edge of observation panels 1605 may have one or more slots (not shown) similar to slots in side panels 1625. Such slots may be portions of the observation panel 1605 that are cut out or otherwise configured to receive tabs 2015 of the living hinge frame 2005. As will be appreciated, in such an embodiment, tabs 2015 may be positioned on living hinge frame 2000 in order to align with the slots of the bottom portion of the observation panel 1605. Additionally, and as will be discussed, in some embodiments, after attachment to the bottom portion of living hinge frame 2000, observation panels 1605 may removably connect to the top portion of the living hinge frame 2000. Further, in such embodiments where observation panels 1605 may removably connect to the top portion of the living hinge frame 2000, insulation 701 may be inserted between observation panel 1605 and the internal contents of the tamper-proof case. In addition to previously described types of materials, insulation 701 may also be made from inflatable material and may be removable through observation panel 1605. As may be appreciated, the connection of the wide panels 1605 to the live-hinge frame 2000 by the live-hinged tabs 2025 provides hinged side doors for inspection of the contents of the tamper-proof case (e.g., wine or spirit bottles).

Figure 20F:
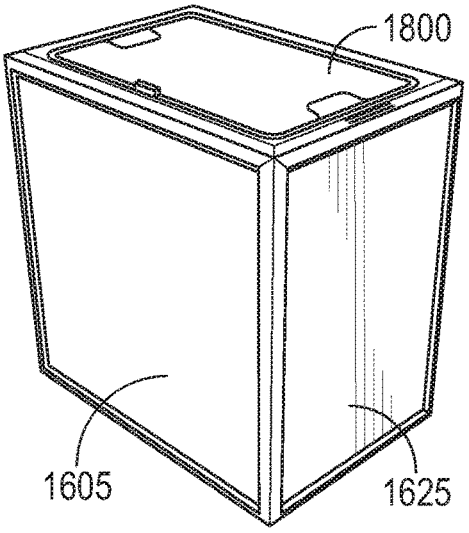

FIG. 20F shows a fully assembled tamper-proof case having a frame 2000 comprising various living hinges 2005, in accordance with an example embodiment of the presently disclosed subject matter. According to some embodiments, when assembled, the live-hinge frame tamper-proof case 2000 may contain a security lid 1800, side panels 1625, observation panels 1605, bottle holders 101*a* and 101*b* (not shown), and living hinge frame 2000.

Figure 21A:
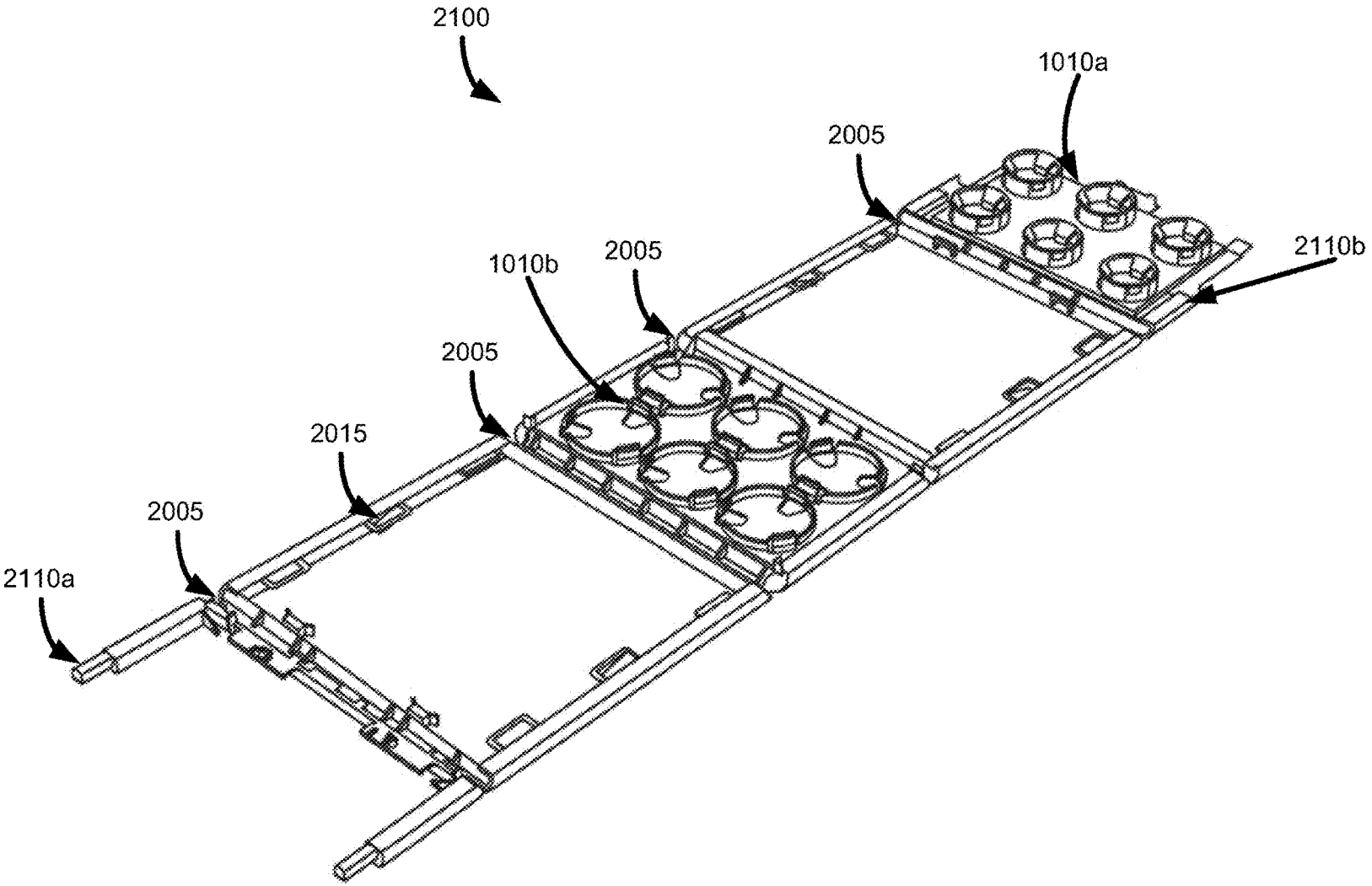
FIGS. 21A-F show the assembly of a tamper-proof case comprising a frame having various living hinges, in accordance with an example embodiment of the presently disclosed subject matter.

FIG. 21A shows a frame 2100 for a tamper-proof case having various living hinges 2005 prior to assembly, in accordance with an example embodiment of the presently disclosed subject matter. Living hinge frame 2100, as depicted in FIG. 21A, may contain similar features as those from living hinge frame 2000 as depicted in FIG. 20A except living hinge frame 2100 may be a unibody frame with bottle holders 101*a* and 101*b* integrally embedded into living hinge frame 2100. For example, as depicted, bottle holder 101*a* may be integrally formed into the bottom portion of the living hinge frame 2100 and bottle holder 101*b* may be integrally formed into the top portion of the living hinge frame 2100. As will be appreciated, such an embodiment requires less separate pieces thus allowing for simplified and streamlined assembly and construction.

Figure 21B:
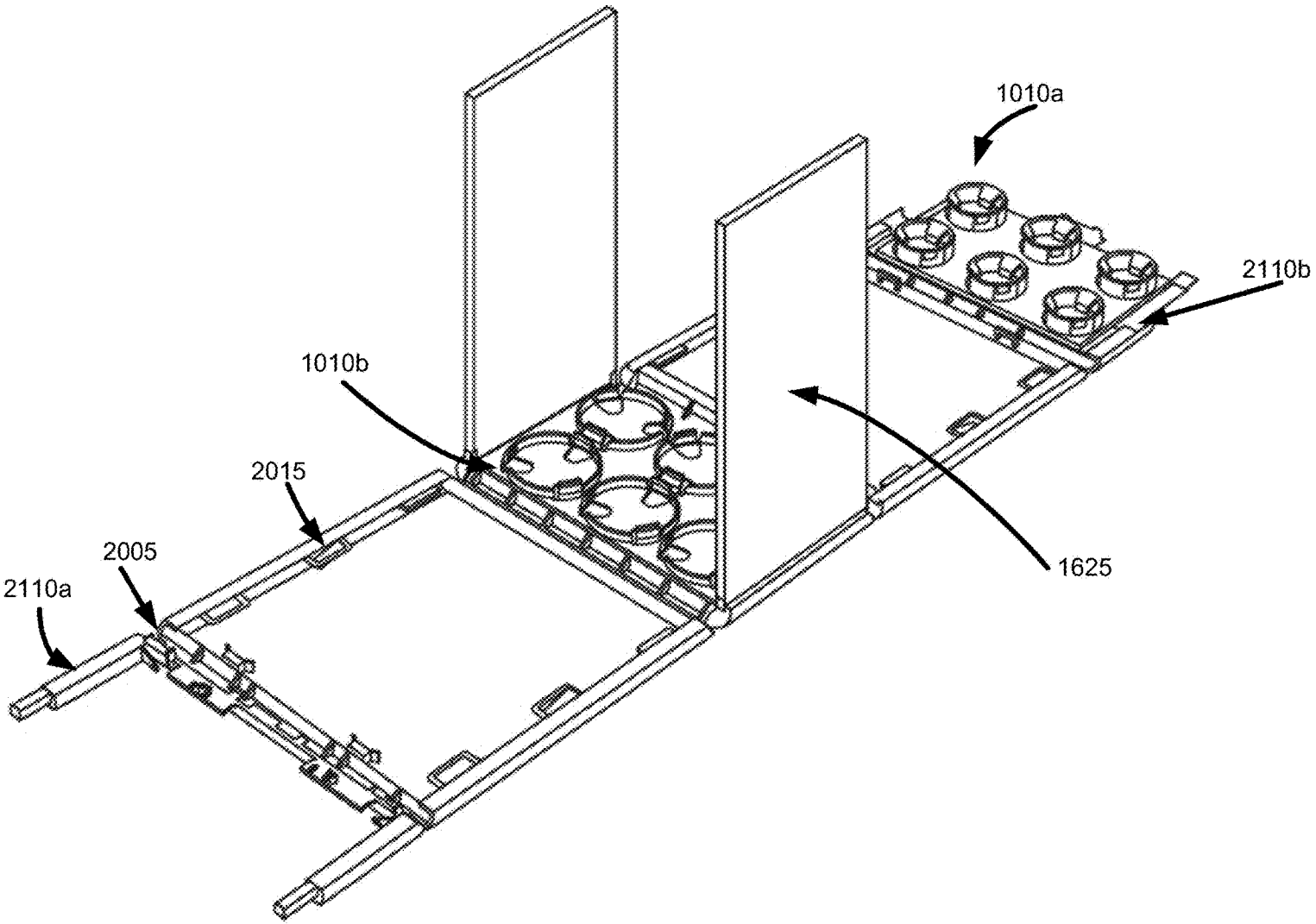
Figure 21C:
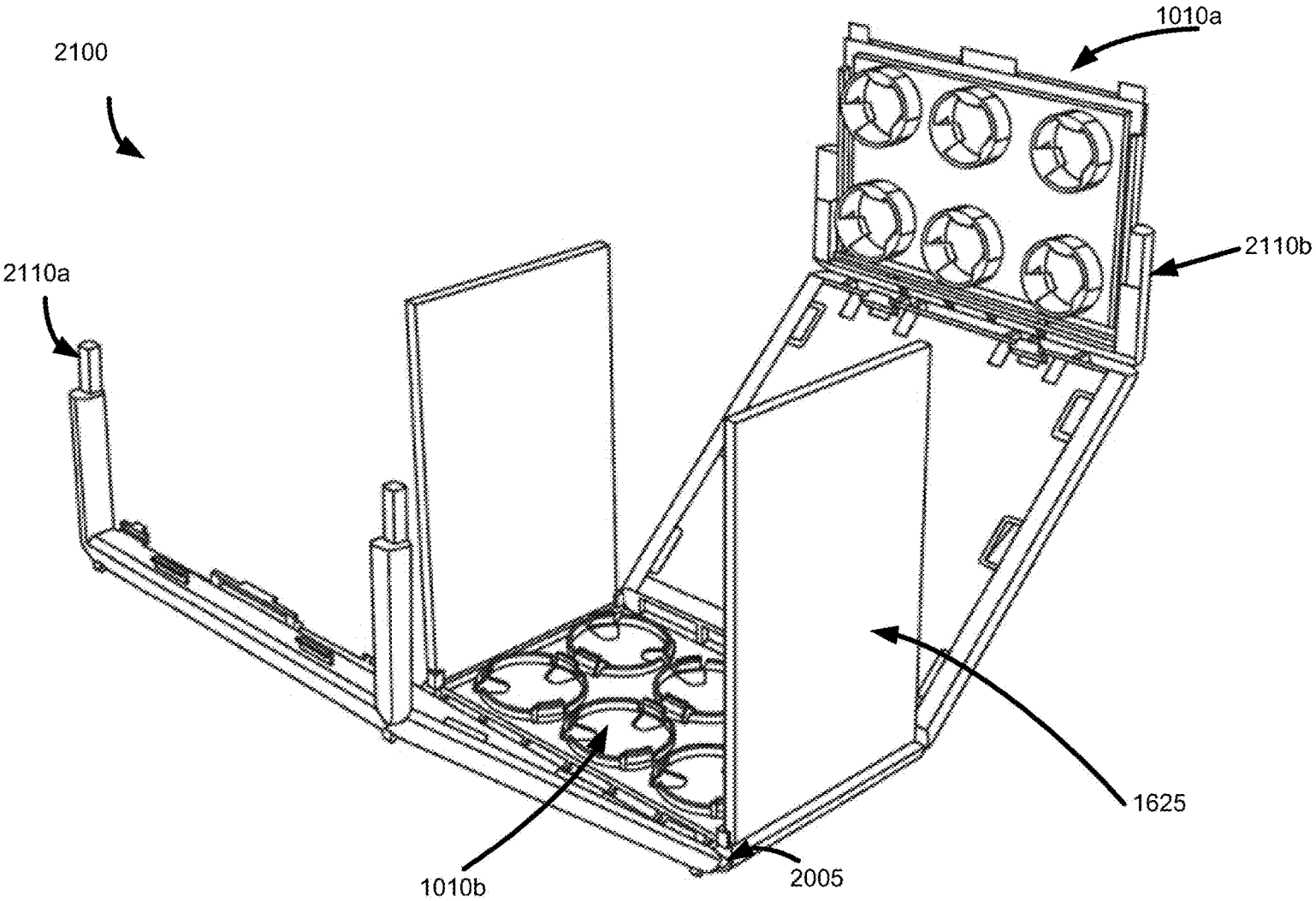
Figure 21D:
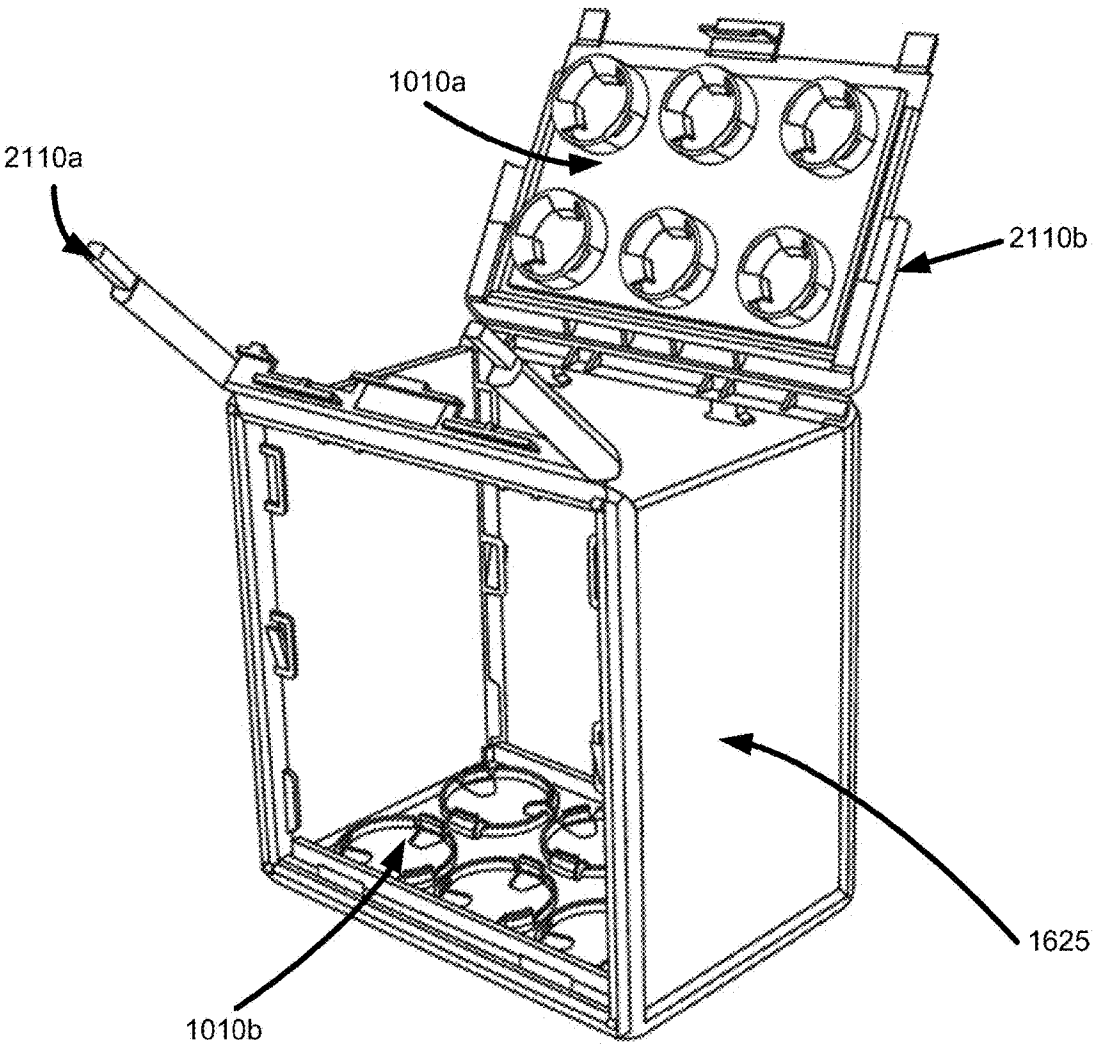

As depicted in FIGS. 21B, 21C, and 21D, side panels 1625 may be integrated into living hinge frame 2100 in a manner similar to that discussed in FIG. 20B with reference to living hinge frame 2000 except living hinge frame 2100 may have bottle holders 101*a* and 101*b* integrally embedded into living hinge frame 2100. For example, as depicted in FIG. 21D, bottle holder 101*b* may be integrally formed into the top portion of the living hinge frame 2100. In some embodiments, living hinge frame 2000 may comprise top lid frame portions or edge attachment arms 2110*a* and 2110*b* and bottle holder 101*b* may be integrated into either top lid frame portion 2110*a* and 2110*b*. For example, in such embodiments, upon folding living hinge frame 2100, top lid frame portions 2110*a* and 2110*b* may connect to form the top surface and cause bottle portion 110*b* to downwardly close onto bottles. As previously discussed, such integration of side panels 1625 into living hinge frame 2100 allows for assembly without the use of nails, glue, or other adherents.

Figure 21E:
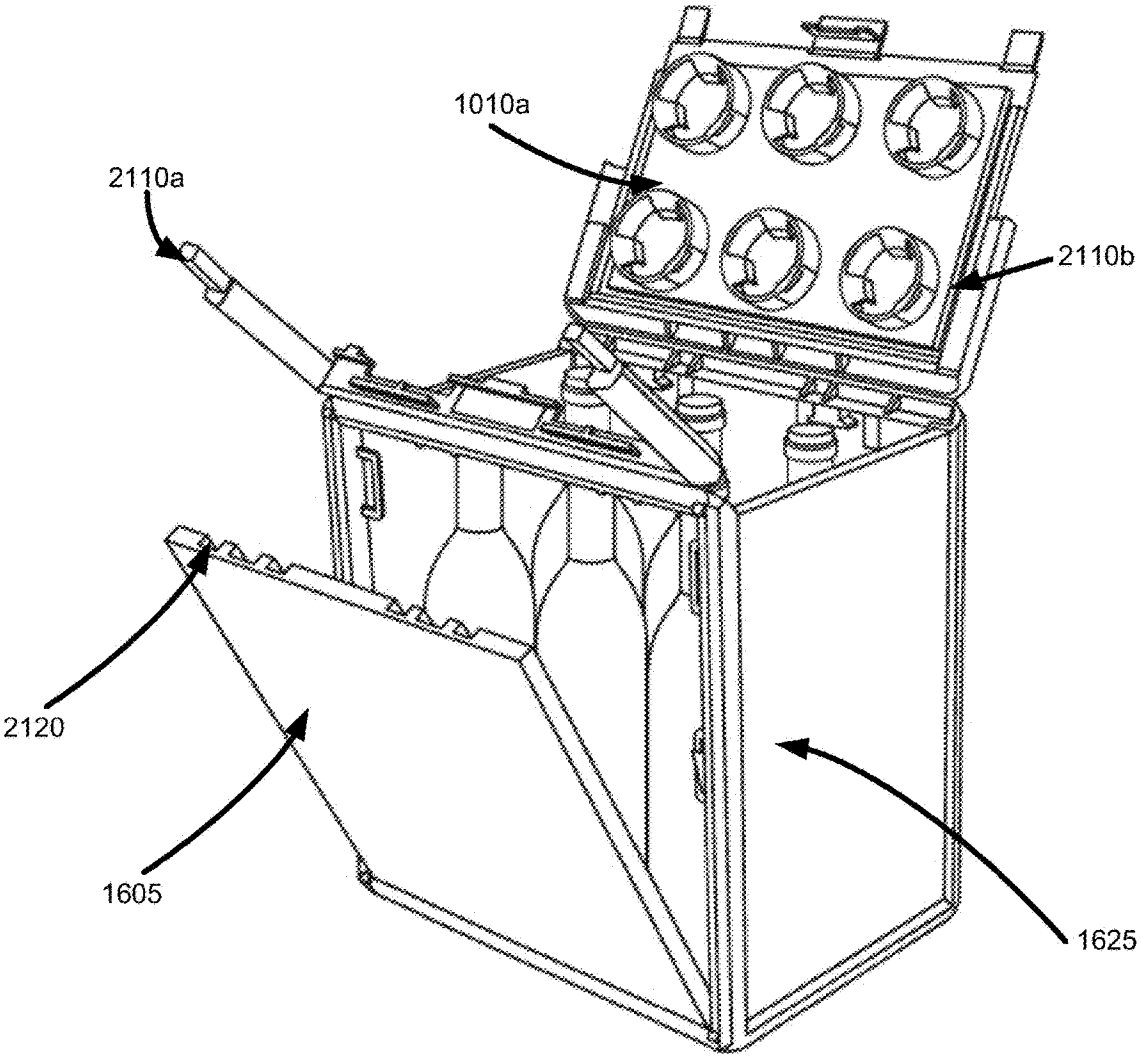
Figure 21F:
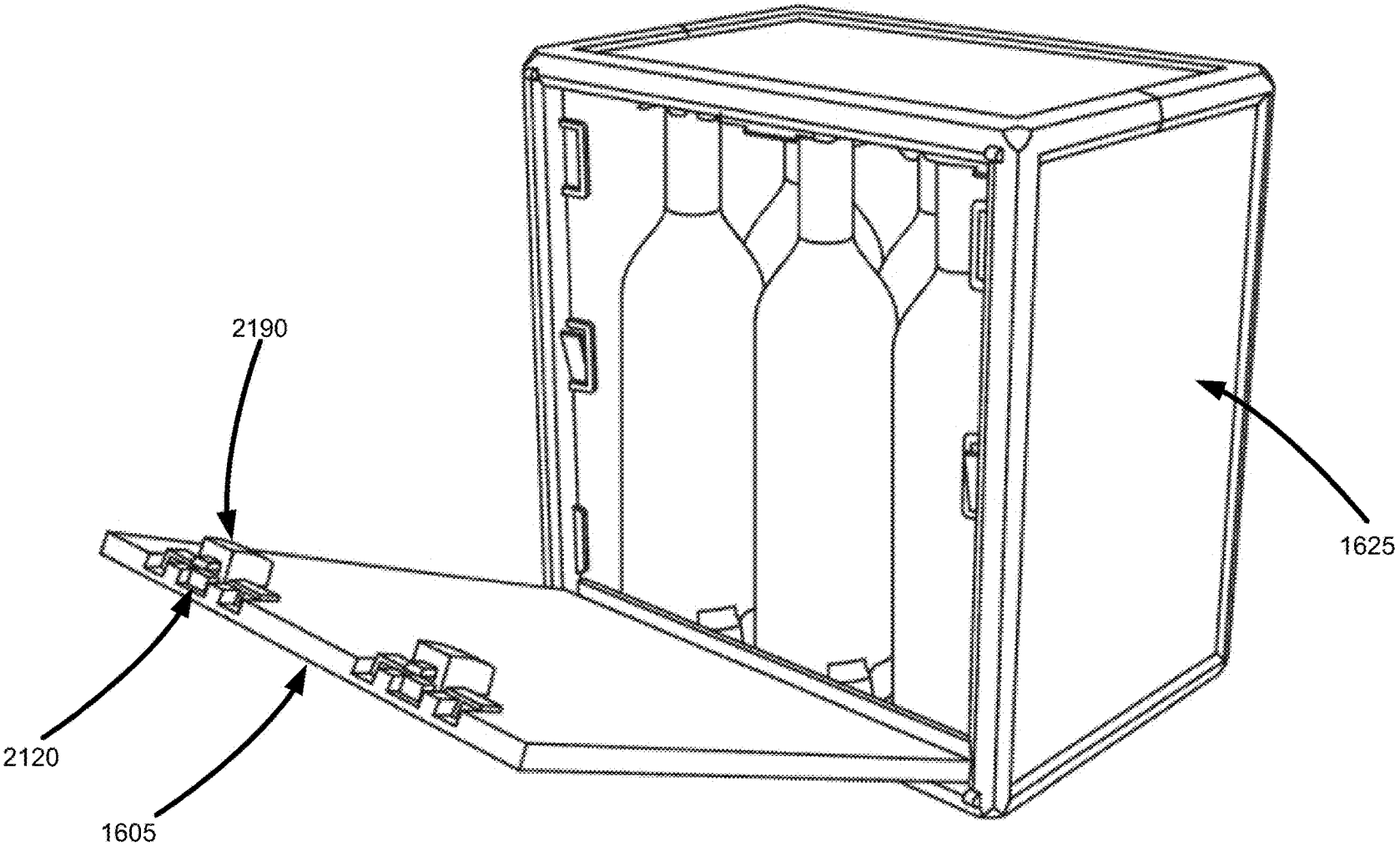

FIG. 21E shows the integration of observation panels 1605 into living hinge frame 2100, in accordance with an example embodiment of the presently disclosed subject matter. Observation panels 1605 may be similarly constructed and may attached to living hinge frame 2100 similarly to observation panels described with regards to FIG. 20E except that, as depicted, observation panel 1605 comprises cutouts 2120 configured to receive a clamp or other suitable attaching means (not pictured), and further discussed herein. Such clamp or attaching means may allow for observation panels 1605 to connect to the top portion of the living hinge frame 2000. In some embodiments, and described further herein, living hinge frame 2100 may have a release mechanism such that clamp may be released, thereby allowing observation panel to be opened after clamp has been closed. FIG. 21F depicts a fully assembled embodiment of the tamper proof case with observation panel 1605 opened and clasp 2190 attached to observation panel 1605.

Accordingly, a user may assemble a tamper-proof case having living hinge frame 2100 to the previously described method or process. For example, a user may insert insulation 701 into living hinge frame 2100 as previously described. A user may subsequently insert product, such as bottles, into bottle holder 101*b* such that bottles are held in place by bottle holder 101*b* and insulation 701 is between the bottles. User may then insert side panels into unibody living hinge frame 2100 as previously discussed and fold living hinge frame 2100 along living hinges from a horizontal position to form a rectangular prism. Before securing the top portion of the living hinge frame 2100 as previously discussed, the user may slide the top and bottom panels into the living hinge frame 2100. The user may then mechanically secure the top portion of the living hinge frame 2100 as previously discussed. After securing the top portion, the user may insert insulation 701, such as inflatable insulation, and attach observation panels 1605. To complete the assembly, the user may then engage the latch or clasp 2190 of the observation panel 1605 with the living hinge frame 2100.

Figure 22A:
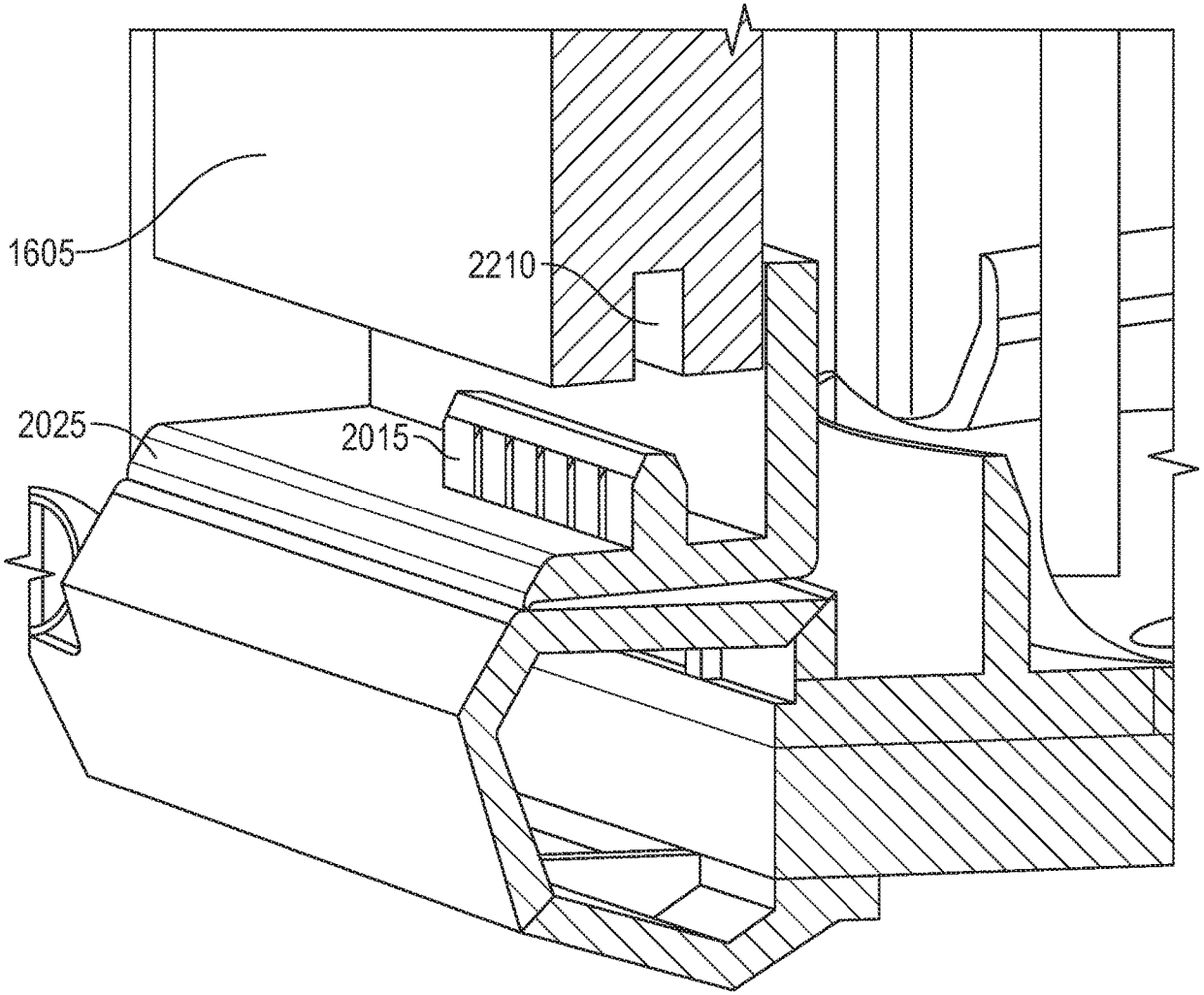
FIGS. 22A-C show perspective views of an assembled observation panel of a tamper-proof case, in accordance with an example embodiment of the presently disclosed subject matter.

FIG. 22A shows a perspective view of observation panel 1605 just before attachment to living hinge frame 2100. As previously discussed, observation panels 1605 may be placed within the living hinge frame 2100 by inserting observation panels 1605 flush against the living hinge tabs 2025. In some embodiments, and as shown, the bottom edge of observation panels 1605 may have one or more slots 2210. As previously discussed, slots may be portions of the observation panel 1605 that are cut out or otherwise configured to receive tabs 2015 of the living hinge frame 2005. In such an embodiment, and as shown, tabs 2015 may be positioned on living hinge frame 2000 in order to align with the slots of the bottom portion of the observation panel 1605.

Figure 22B:
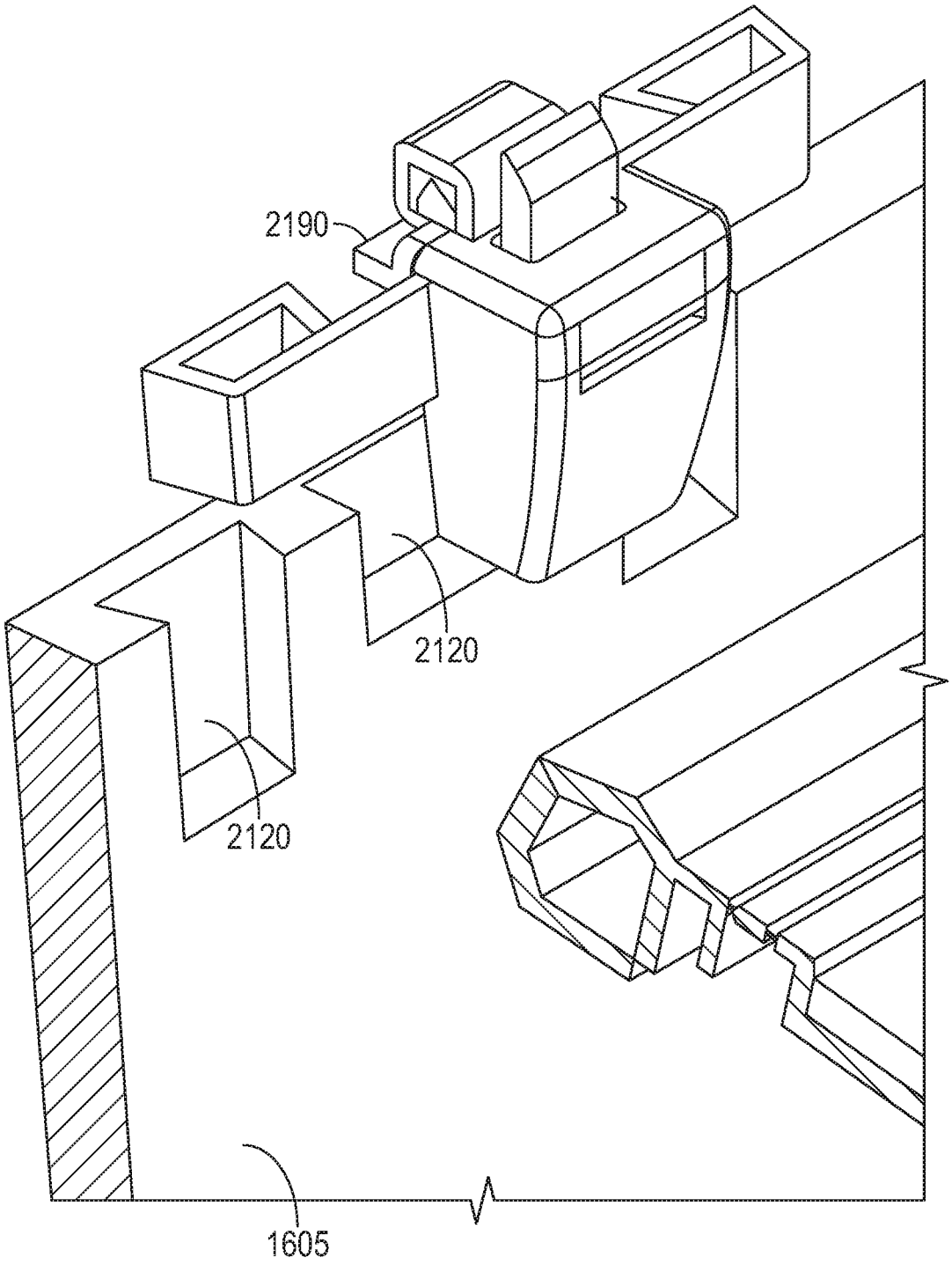

FIG. 22B shows a perspective view of clasp 2190 just before attachment to observation panel 1605. As previously discussed, observation panels may have cutouts 2120 configured to receive clasp 2190. According to some embodiments, and as will be appreciated by one of skill in the art, cutouts 2120 may be formed in the fashion of a mortise and tenan joint or any other suitable formation that would allow for connection to be made between observation panel 1605 and clasp 2190.

Figure 22C:
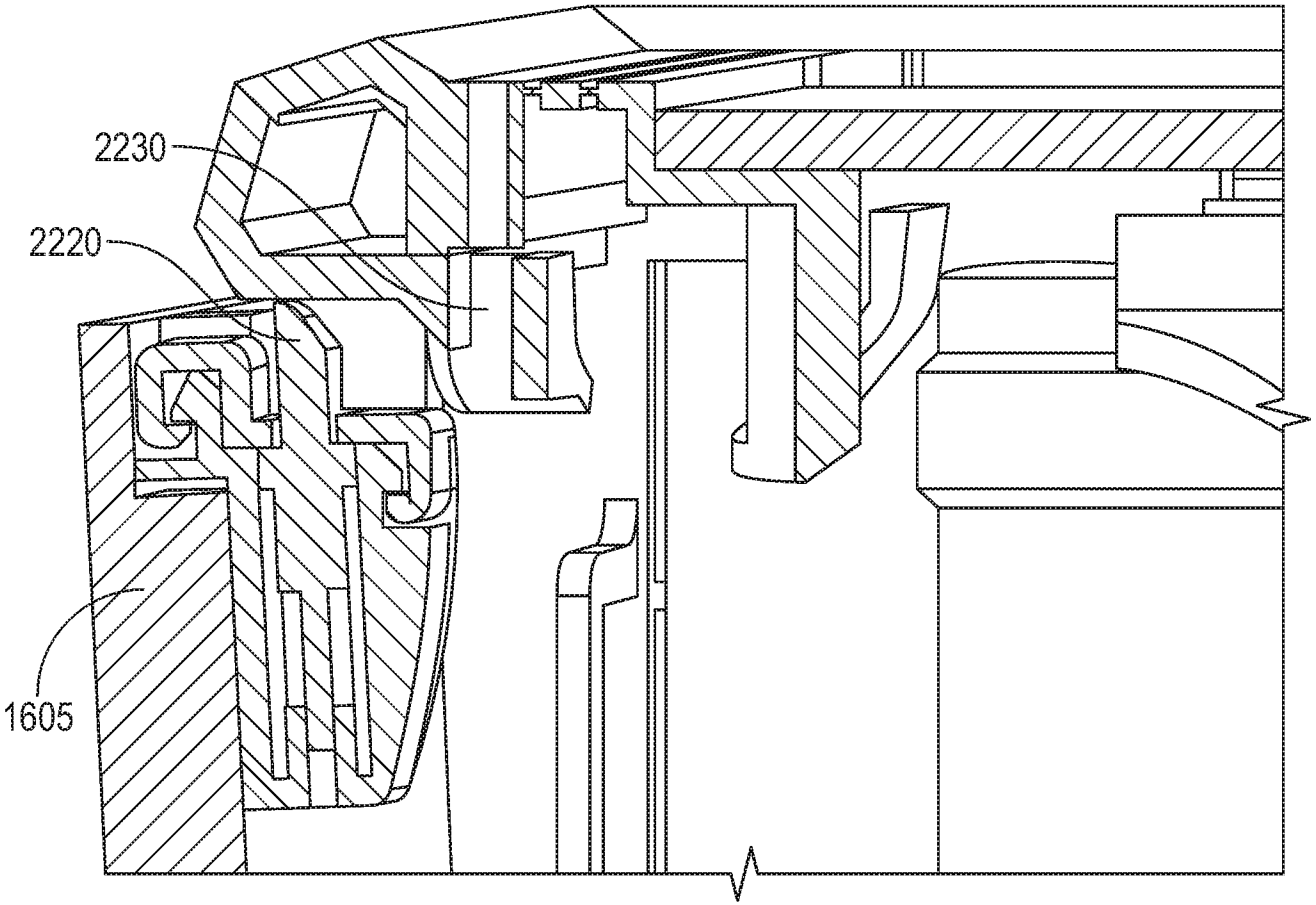

FIG. 22C shows a perspective view of observation panel 1605 just before being closed. As shown, clasp 2190 may comprise a deformable male portion 2220 and living hinge frame 2100 may comprise a female receiving portion 2230. In such an embodiment, for example, when observation panel 1605 is moved towards the close position, deformable male portion 2220 may make contact with living hinge frame 2100 and deforms. Once observation panel 1605 reaches the closed position, deformable male portion 2220 may be able to return to initial position inside female receiving portion 2230, thus locking the observation panel 1605. As will be discussed further herein, living hinge frame 2100 may comprise a mechanism for releasing observation panels 1605. As will be appreciated, any such mechanism would have to cause deformable male portion 2220 to deform in order to release observation panel 1605.

Figure 23A:
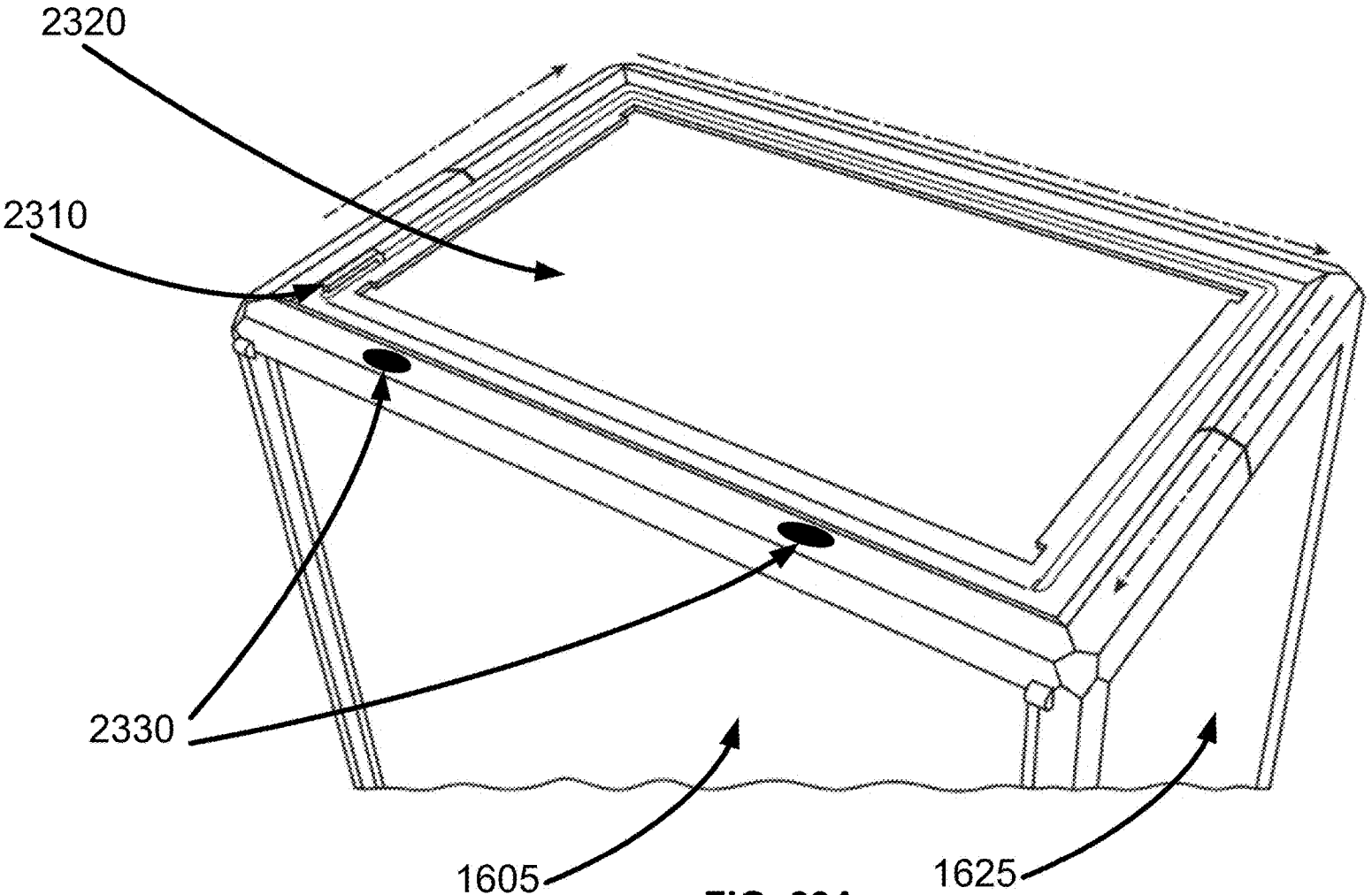
FIGS. 23A-B show a process of opening a tamper-proof case, in accordance with an example embodiment of the presently disclosed subject matter.

FIG. 23A is a detailed view demonstrating the detachment of a removable pull tab 2310 from top panel 2320 of tamper-proof case. As shown, the top panel can include one or more integrated, removable pull tabs 2310. In some embodiments, pull tabs 2310 may traverse one or more sides of top panel 2320. For example, in some embodiments, pull tab 2310 may traverse all four sides. In some embodiments, pull tab 2310 may traverse three sides. As will be understood, pull tabs 2310 can be configured to a size and shape consistent with the top panel 2320 of tamper-proof case. In some embodiments, when a user pulls the removable pull tab 2310, the top portion may become loosened from the locked position such that the case may be opened and the internal contents accessible. As will be appreciated, by including a tamper-proof seal, shippers and recipients can be assured that the contents inside the tamper-proof case have not been disturbed.

Additionally, as shown in FIG. 23A, tamper-proof case may comprise observation panel release mechanism 2330. In some embodiments, observation panel release mechanism 2230 may be a push type mechanism accessible through a port 2330 on living hinge frame 2100. In such embodiments, port may be configured to receive a key. As will be appreciated, such an embodiment would increase the security of the contents of the case by limiting a user's ability to open an observation panel.

Figure 23B:
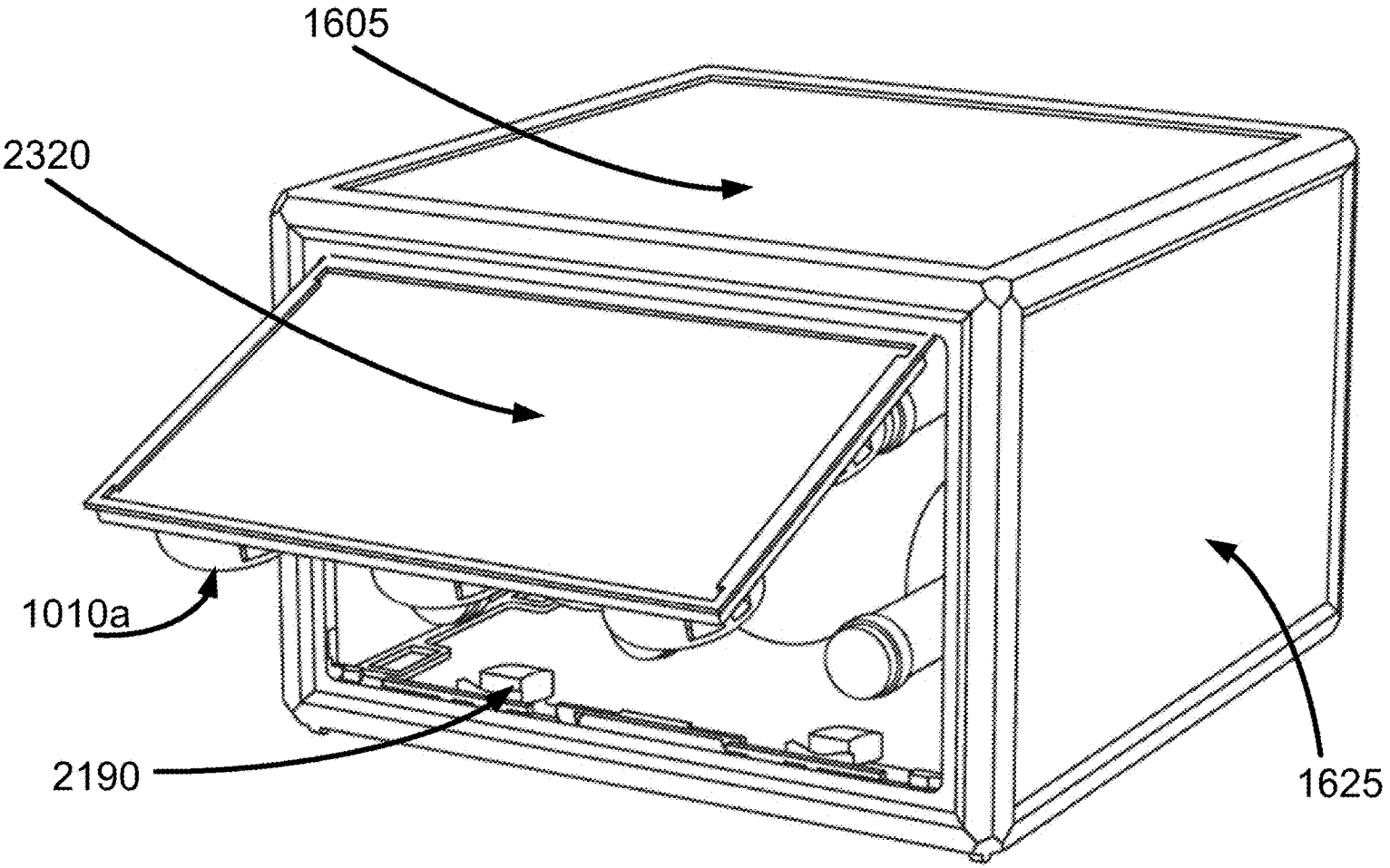

FIG. 23B shows the removal of a pull tab 2310, in accordance with an example embodiment of the presently disclosed subject matter. As shown, pull tab 2310 has been released and removed from top panel 2320 of tamper-proof case, top panel 2320 may be opened about living hinge 2005, thus providing access to the contents of the tamper-proof case.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tamper-proof wine crate comprising:

four side panels;

a bottom panel;

a top panel; and a unibody frame having a plurality of living hinges, the living hinges configured such that the unibody frame can be folded from a first configuration into a second configuration, the first configuration being a substantially horizontal configuration, and the second configuration being a rectangular prism configuration, the rectangular prism comprising:

four substantially vertical side faces, each of the vertical side faces having a top edge and a bottom edge, and each of the vertical side faces adapted to receive a respective one of the four side panels to form respective crate sidewalls;

a substantially horizontal bottom face in mechanical communication with each bottom edge of the vertical side faces, the bottom face having a plurality of bottle heel receiving cups disposed toward an interior volume of the crate, and the bottom face adapted to receive the bottom panel; and a substantially horizontal top face having a first edge in mechanical communication with a first vertical side face's top edge and having a second edge in mechanical communication with a second vertical side face's top edge, the first vertical side face disposed opposite from, and generally parallel to, the second vertical side face, the top face having a plurality of bottle top receiving cups disposed toward the interior volume of the crate, and the top face adapted to receive the top panel.

2. The tamper-proof wine crate of claim 1, wherein the top face comprises a sealed hinged lid, the sealed hinged lid having a removable pull tab disposed around first, second, and third edges of the sealed hinged lid.

3. The tamper-proof wine crate of claim 2, wherein, when the removable pull tab is removed from the sealed hinged lid, the sealed hinged lid can be transitioned from a closed position to an open position.

4. The tamper-proof wine crate of claim 3, wherein the removable pull tab is not replaceable once removed from the sealed hinged lid.

5. The tamper-proof wine crate of claim 1, wherein the top face comprises a sealed hinged lid, the sealed hinged lid having a removable pull tab disposed around first, second, third, and fourth edges of the sealed hinged lid.

6. The tamper-proof wine crate of claim 1, wherein tamper-proof wine crate further comprises insulation inside the crate.

7. The tamper-proof wine crate of claim 6, wherein the insulation is composed of an inflatable material.

8. The tamper-proof wine crate of claim 1, wherein at least one crate sidewall is configured as an observation panel such that the at least one crate sidewall's side face's bottom edge comprises at least one observation panel living hinge tab, and the at least one crate sidewall's side panel comprises (i) a latch configured to engage the top face and (ii) a bottom edge that is in mechanical communication with the at least one observation panel living hinge tab such that, when the latch is disengaged, the observation panel can transition from a first, substantially vertical position, to a second, substantially horizontal position, allowing observation of contents inside the tamper-proof wine crate.

9. The tamper-proof wine crate of claim 8, wherein the latch configured to engage the top face further comprises a deformable male portion.

10. The tamper-proof wine crate of claim 1, wherein the four side panels, bottom panel, and top panel are made from the same material.

11. The tamper-proof wine crate of claim 1, wherein the four side panels, bottom panel, and top panel are made from different materials.

12. The tamper-proof wine crate of claim 1, wherein the four side panels, bottom panel, and top panel are made from wood.

13. The tamper-proof wine crate of claim 1, wherein the first edge is in mechanical communication with the first vertical side face's top edge via a first living hinge, the first edge comprising first and second first edge attachment arms at respective first and second ends of the first edge and (ii) the second edge is in mechanical communication with the second vertical side face's top edge via a second living hinge, the second edge comprising first and second second edge attachment arms at respective first and second ends of the second edge.

14. The tamper-proof wine crate of claim 13, wherein, when the first edge and the second edge are in respective first positions, the first and second first edge attachment arms and the first and second second edge attachment arms are in substantially vertical positions, and when the first edge and the second edge are in respective second positions, the first and second first edge attachment arms and the first and second second edge attachment arms are in substantially horizontal positions.

15. The tamper-proof wine crate of claim 14, wherein the first first edge attachment arm is disposed generally opposite the first second edge attachment arm, and the second first edge attachment arm is disposed generally opposite the second second edge attachment arm.

16. The tamper-proof wine crate of claim 15, wherein the first first edge attachment arm and the first second edge attachment arm comprise respective first and second interlocking components of a first locking mechanism and the second first edge attachment arm and the second second edge attachment arm comprise respective first and second interlocking components of a second locking mechanism such that, when the first and second edge are in respective second positions, the respective first and second interlocking components of the first locking mechanism and the respective first and second interlocking components of the second locking mechanism interlock to place the top face in a locked state.

17. The tamper-proof wine crate of claim 16, wherein, when the top face is in a locked state, the top face cannot be placed in an unlocked state without damaging the first and second locking mechanisms.

18. The tamper-proof wine crate of claim 1, wherein the unibody frame is composed of plastic.

19. The tamper-proof wine crate of claim 1, further comprising integrated tabs positioned so as to contact the four side panels.

20. The tamper-proof wine crate of claim 19, wherein the integrated tabs are serrated.

* * * * *